US008120561B2

(12) United States Patent
Kudo et al.

(10) Patent No.: US 8,120,561 B2
(45) Date of Patent: Feb. 21, 2012

(54) DISPLAY APPARATUS AND DRIVING DEVICE FOR DISPLAYING

(75) Inventors: Yasuyuki Kudo, Kamakura (JP); Akihito Akai, Yokohama (JP); Kazuo Ookado, Kokubunji (JP); Kazunari Kurokawa, Mobara (JP); Hiroki Aizawa, Chigasaki (JP)

(73) Assignee: Renesas Electronics Corporation, Kanagawa (JP)

( * ) Notice: Subject to any disclaimer, the term of this patent is extended or adjusted under 35 U.S.C. 154(b) by 424 days.

(21) Appl. No.: 12/411,984

(22) Filed: Mar. 26, 2009

(65) Prior Publication Data

US 2009/0184985 A1 Jul. 23, 2009

Related U.S. Application Data

(63) Continuation of application No. 11/248,308, filed on Oct. 13, 2005, now Pat. No. 7,511,693, which is a continuation of application No. 10/161,635, filed on Jun. 5, 2002, now Pat. No. 7,023,458.

(30) Foreign Application Priority Data

Jun. 7, 2001 (JP) ..... 2001-171886

(51) Int. Cl.
*G09G 3/36* (2006.01)

(52) U.S. Cl. ..... 345/89

(58) Field of Classification Search ..... 345/89.69, 345/95, 100

See application file for complete search history.

(56) References Cited

U.S. PATENT DOCUMENTS

| | | | | |
|---|---|---|---|---|
| 5,627,457 | A | 5/1997 | Ishiyama et al. | |
| 5,686,934 | A | 11/1997 | Nonoshita et al. | |
| 6,046,719 | A | 4/2000 | Dingwall | |
| 6,118,425 | A | 9/2000 | Kudo et al. | |
| 6,225,992 | B1 | 5/2001 | Hsu et al. | |
| 6,275,207 | B1 | 8/2001 | Nitta et al. | |
| 6,275,209 | B1 * | 8/2001 | Yamamoto | 345/95 |
| 6,304,255 | B1 * | 10/2001 | Suzuki et al. | 345/211 |
| 6,633,271 | B1 * | 10/2003 | Motegi et al. | 345/87 |
| 2002/0163524 | A1 * | 11/2002 | Dutta | 345/589 |
| 2002/0180680 | A1 * | 12/2002 | Moon | 345/89 |

FOREIGN PATENT DOCUMENTS

| | | |
|---|---|---|
| JP | 5-19725 | 1/1993 |
| JP | 6-348235 | 12/1994 |
| JP | 7-98577 | 4/1995 |
| JP | 10-62743 | 3/1998 |
| JP | 10-260658 | 9/1998 |

(Continued)

*Primary Examiner* — Richard Hjerpe
*Assistant Examiner* — Leonid Shapiro
(74) *Attorney, Agent, or Firm* — Antonelli, Terry, Stout & Kraus, LLP.

(57) ABSTRACT

A display driving circuit to supply a gray scale voltage corresponding to display data to a display panel, the display driving circuit including: a generation circuit to divide a reference voltage to generate a plurality of levels of the gray scale voltages; an interface circuit; a selection circuit to select the gray scale voltage corresponding to the display data from the plurality of levels of voltages; a first register to store a setting value that adjusts the amplitude of a gamma characteristic curve from outside via the interface circuit; and a second register to store a setting value that adjusts the gradient of the gamma characteristic curve from outside via the interface circuit; and a third register to store a setting value for micro adjusting the gamma characteristic curve from outside via the interface circuit; wherein the first, second and third registers are assigned different addresses.

17 Claims, 16 Drawing Sheets

FOREIGN PATENT DOCUMENTS

| | | |
|---|---|---|
| JP | 11-24037 | 1/1999 |
| JP | 11-175027 | 7/1999 |
| JP | 2001-13478 | 1/2001 |
| JP | 2001-22325 | 1/2001 |
| JP | 2001-042833 | 2/2001 |
| JP | 2001-125063 | 5/2001 |

* cited by examiner

FIG. 4A
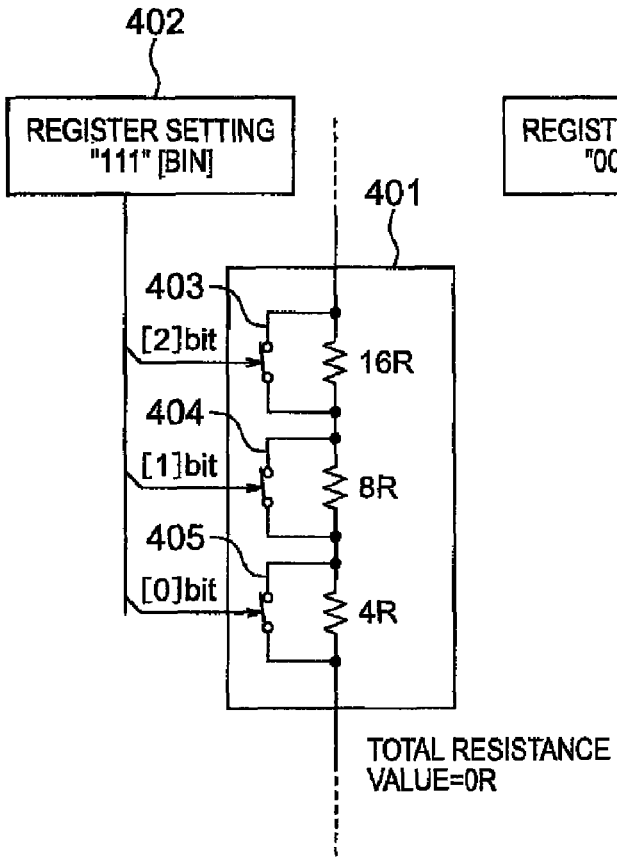
FIG. 4B
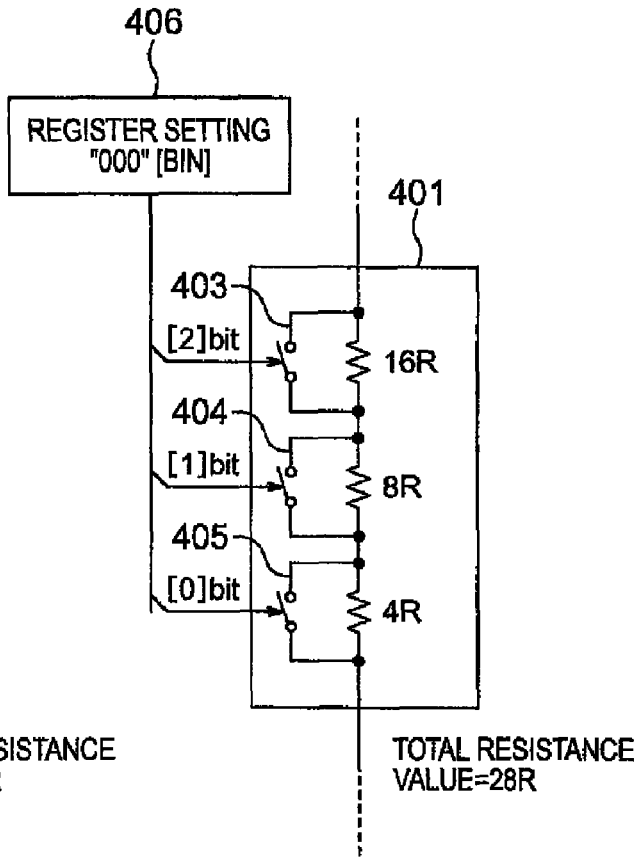
FIG. 4C
407
| REGISTER SETTING [BIN] | VARIABLE RESISTANCE VALUE |
|---|---|
| 111 | 0R |
| 110 | 4R |
| 101 | 8R |
| 100 | 12R |
| 011 | 16R |
| 010 | 20R |
| 001 | 24R |
| 000 | 28R |

707

| REGISTER SETTING [BIN] | VOLTAGE WITH RESISTANCE DIVIDED [V] |
|---|---|
| 111 | H |
| 110 | G |
| 101 | F |
| 100 | E |
| 011 | D |
| 010 | C |
| 001 | B |
| 000 | A |

DISPLAY APPARATUS AND DRIVING DEVICE FOR DISPLAYING

CROSS REFERENCE TO RELATED APPLICATION

This is a continuation of U.S. application Ser. No. 11/248,308, filed Oct. 13, 2005, now U.S. Pat. No. 7,511,693 which is a continuation of U.S. application Ser. No. 10/161,635, filed Jun. 5, 2002 (now U.S. Pat. No. 7,023,458), the subject matter of which is incorporated by reference herein. This application relates to U.S. application Ser. No. 11/126,160, filed on May 11, 2005 (now U.S. Pat. No. 7,193,637). This application further relates to and claims priority from Japanese Patent Application No. 2001-171886, filed on Jun. 7, 2001. The entirety of the contents and subject matter of all of the above is incorporated herein by reference.

BACKGROUND OF THE INVENTION

The present invention relates to a display apparatus having a display panel in which display pixels are arranged in a matrix and a driving device for supplying to the display panel a gray scale voltage corresponding to display data. More specifically, the invention relates to a display apparatus that uses a liquid crystal material, organic EL, and plasma and its driving device for displaying.

JP-A-2001-13478 discloses a liquid crystal display apparatus source driver that constitutes a reference voltage generating circuit for generating a gamma correction reference voltage by resistive voltage division, and a resistance setting circuit for selecting a resistance to be used for the resistive voltage division from among a plurality of resistances. The reference further discloses that a gamma correction setting register receives data for setting the value of resistance, appeared on a display data line, in response to a clock signal CK when an enable signal E goes to "H", and then switching on or off respective switches for resistances and other switches that comprise the reference voltage generating circuit according to the bit value of the received data for setting the value of resistance, thereby determining the reference voltage.

JP-A-6-348235 discloses a liquid crystal display apparatus that constitutes a liquid crystal display panel having a X signal line and a Y signal line, a horizontal driver for selecting a gray scale signal from among a plurality of gray scale signals supplied from a gray scale voltage generating circuit, on the basis of a data signal of an image to be displayed, for supply onto the X signal line of the liquid crystal display panel, and a vertical driver for supplying a liquid panel scanning signal onto the Y signal line of the liquid crystal display panel. The reference further discloses that the gray scale voltage generating circuit constitutes a plurality of fixed resistances interposed in series between the sides of the reference voltage of a high potential and the reference voltage of a low potential, and voltage varying unit for varying a voltage at a connection point between the fixed resistances to a voltage between the high potential reference voltage and the low potential reference voltage, thereby supplying the voltage at the connection point between the fixed resistances as a gray scale signal. The reference furthermore discloses that by adjusting the resistance value of a variable resistance in the above-mentioned manner, the voltage level of the gray scale signal or a gray scale voltage can be arbitrarily adjusted, so that gray scale characteristics can be freely modified.

JP-A-11-24037 discloses a gray scale voltage generating circuit that constitutes amplification unit for generating a variable intermediate-level gray scale voltage from an intermediate-level reference voltage and amplification unit for supplying gray scale voltages of negative polarity. The former amplification unit divides a reference supply voltage with the resistance divided for amplification, thereby generating a higher gray scale voltage of positive polarity and a lower gray scale voltage of positive polarity. Then, the amplification unit further divides these voltages with the resistance divided, thereby generating the intermediate-level reference voltage. Finally, the amplification unit generates the variable intermediate level-gray scale voltage from the intermediate-level reference voltage, using a variable resistance as a feedback resistance. The latter amplification unit inverse-amplifies all the gray scale voltages of positive polarity, obtained by dividing the resistive voltage and then amplifying the reference supply voltage, at the same amplification factor with respect to a liquid crystal GND potential, for supply as the gray scale voltages of negative polarity. The reference further discloses that the gray scale characteristics can be adjusted just by adjusting a single variable resistance.

In the above-mentioned art, however, among 64 gray scale levels of voltages, the voltages at the two ends are fixed as a GND voltage or the reference voltage externally supplied. Accordingly, adjustment to the gray scale voltage fixed as the GND voltage is impossible. Further, for adjustment to the gray scale voltage fixed as the reference voltage, an additional adjustment circuit becomes necessary outside the gray scale voltage generating circuit, thus leading to an increase in the number of components. Though there are some cases where adjustment to the voltages of the gray scale levels at the two ends becomes necessary due to the characteristic differences of liquid crystal display panels, the above-mentioned techniques did not take such cases into consideration.

JP-A-11-175027 discloses a liquid crystal driving circuit that constitutes a latch address control circuit, a first holding circuit, a second holding circuit, setting registers, a gray scale voltage generating circuit, a gray scale voltage selector circuit, and an amplifier circuit. The latch address control circuit sequentially generates latch signals that receive display data. The first holding circuit holds the number of display data equivalent to the number of output data lines in response to a latch signal, and the second holding circuit receives and then holds the number of display data held in the first holding circuit, equivalent to the number of the output data lines in response to a horizontal synchronization signal. The setting registers control the value of a gray scale voltage. The gray scale voltage generating circuit receives a plurality of different reference voltages to generate a gray scale voltage specified by one of the setting registers. The gray scale voltage selector circuit selects a gray scale voltage according to the display data held in the second holding circuit, and the amplifier circuit shifts the gray scale voltage selected by the selector circuit so as to be more closer to an offset voltage, and amplifies the gray scale voltage by an amplitude factor specified by one of the setting registers, for supply. The reference further discloses that the setting registers for setting the amplification factor of respective operational amplifiers in the amplifier circuit are provided for respective R, G, and B display colors, and that a voltage setting can be changed according to each of the colors. The reference further discloses that an offset voltage setting can be changed, because the offset voltage of the amplifier circuit is generated by dividing an offset reference voltage with the resistance divided and a common voltage, using a plurality of variable resistances, the resistance value of which can be set. In the above-mentioned art, however, an offset adjustment circuit becomes necessary in the amplified circuit. Thus the size of the driving circuit becomes large, so that the cost of the circuit increases. Further, in this art, a gamma correction control register sets the resistance values of all the variable resistances in a resistance ladder for adjustment so as to obtain a desired gamma characteristic. Accordingly, if the resistance value of a single variable resistance is adjusted, the overall resistive voltage division ratio would be changed. This leads to a change in all the gray scale voltages. Thus, in order to adjust gray scale voltages according to the respective characteristics completely, it would take much time. Further, The reference does not disclose adjustment to the gray scale voltage amplitude.

JP-A-2001-22325 discloses a liquid crystal display apparatus that constitutes a pair of amplifiers, a voltage dividing circuit for generating a plurality of a pair of symmetrical reference voltages of positive and negative polarities from standard voltages of positive and negative polarities, and a variable voltage generating circuit for supplying a pair of symmetrical reference voltages of positive and negative polarities for gray scale adjustment to a pair of voltage dividing points in the voltage dividing circuit, associated with specific intermediate gray scale levels. The reference further discloses that by increasing a positive reference voltage $V_{x-2}$ from a positive reference voltage $V_{x-1}$ by a desired value and decreasing a negative $V_{x+1}$ from $V_x$ by the desired value simultaneously in the variable voltage generating circuit in a normally white mode, the voltage values of reference voltages $V_0$ to $V_{x-2}$, $V_{x+1}$ to $V_{2x-1}$ can be changed smoothly. The reference discloses that, with this arrangement, adjustment to and modification of a gray scale level-brightness characteristic can be easily performed by a single variable voltage generating circuit.

However, the above-mentioned art does not display insertion of a variable resistance into the reference voltage generating circuit, and does not disclose adjustment to the amplitude of a gray scale voltage.

SUMMARY OF THE INVENTION

An object of the present invention is to provide a display apparatus and a display driving device in which, by adjusting both of the gradient and the amplitude of a gray scale number-gray scale voltage characteristic, adjusting accuracy is improved, and image quality is thereby improved.

Therefore, a display apparatus and a display driving device according to the present invention comprise a gray scale voltage generating circuit for generating a plurality of levels of a gray scale voltage from a reference voltage, an amplitude adjustment register capable of setting the amplitude of a characteristic curve of a plurality of levels of the gray scale voltage with respect to gray scale numbers, and a gradient adjustment register capable of setting the gradient of the characteristic curve.

Then, preferably, the display apparatus and the display driving device according to the present invention further comprise resistive voltage dividing circuits for dividing the reference voltage with resistance divided, an amplitude adjustment variable resister connected in series with the side of the reference voltage closer to the side of the reference voltage than the resistive voltage dividing circuits, the resistance setting of which is adjustable according to a setting in the amplitude adjustment register, and a gradient adjustment variable resister connected in series with the resistive voltage display circuits, the resistance setting of which is adjustable according to a setting in the gradient adjustment register.

Alternatively, preferably, the display apparatus and the display driving device according to the present invention further comprise resistive voltage dividing circuits for dividing the reference voltage with the resistance divided, an amplitude adjustment variable resister connected in series with ground, closer to the ground than the resistive voltage dividing circuits, the resistance setting of which is adjustable according to a setting in the amplitude adjustment register, and a gradient adjustment variable resister connected in series with the resistive voltage dividing circuits, the resistance setting of which is adjustable according to a setting in the gradient adjustment register.

According to the present invention, both of the gradient and the amplitude of the gray scale number-gray scale voltage characteristic can be adjusted. Thus, adjusting accuracy is improved, and image quality is thereby improved.

Other objects, features and advantages of the invention will become apparent from the following description of the embodiments of the invention taken in conjunction with the accompanying drawings.

BRIEF DESCRIPTION OF THE DRAWINGS

FIGS. 4A and 4B are a block diagram showing configurations of a variable resister according to the first embodiment of the present invention;

FIG. 4C is a table showing a relationship between a register setting and the resistance value of the variable resister according to the first embodiment of the present invention, respectively;

DETAILED DESCRIPTION OF THE EMBODIMENTS

Figure 1A:
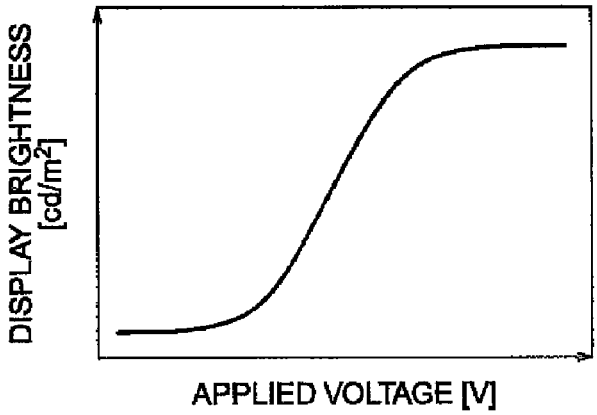
FIGS. 1A, 1B, and 1C are characteristic curves showing a gamma characteristic of a typical liquid crystal display panel.

A typical gamma characteristic will be described with reference to FIGS. 1A, 1B, and 1C. FIG. 1A shows an applied voltage-brightness characteristic when a liquid crystal display panel is in a normally black mode. The smaller the applied voltage is, the lower the brightness becomes, and the larger the applied voltage is, the higher the brightness becomes. It can be seen from this characteristic curve that a change in the brightness with respect to the applied voltage is slow or becomes saturated in a low applied voltage region and a high applied voltage region.

In addition to liquid crystal display panels in the normally black mode, there are also liquid crystal display panels in a normally white mode. However, a description herein will be directed to the case where the liquid crystal display panel is in the normally black mode. Incidentally, the present invention can be practiced irrespective of the mode of the liquid crystal display panel.

Figure 1B:
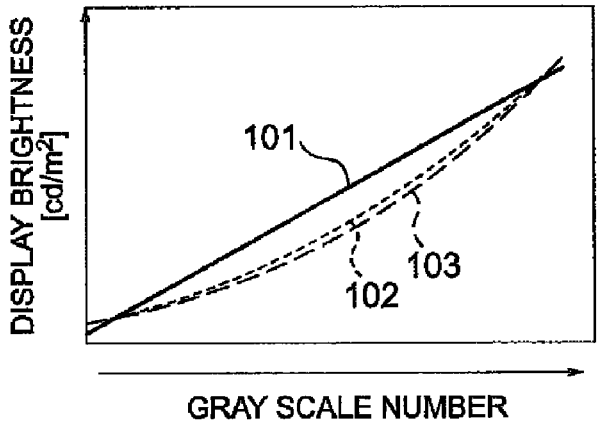

Next, FIG. 1B shows gray scale number-brightness characteristics. This characteristic is commonly referred to as the gamma characteristic. A solid line indicated by reference numeral 101 shows the characteristic that the brightness linearly increases as the gray scale number increases, and this characteristic is defined as the characteristic when $\gamma=1.0$. The value of $\gamma$ is obtained from the following expression (1):

$$(\text{gray scale number})^{\gamma}=\text{brightness } [\text{cd/m}^2] \quad (1)$$

From the above expression (1), it can be seen that curves indicated by reference numerals 102 and 103 show the characteristics when $\gamma=2.2$ and $\gamma=3.0$, respectively. Traditionally, when display data is displayed on the liquid crystal display panel, the gamma characteristic a person perceives has the highest image quality is generally the characteristic indicated by the curve 102 when $\gamma=2.2$.

Thus, in a liquid crystal display apparatus, by adjusting an applied voltage for each gray scale number, adjustment to the gamma characteristic is made.

Figure 1C:
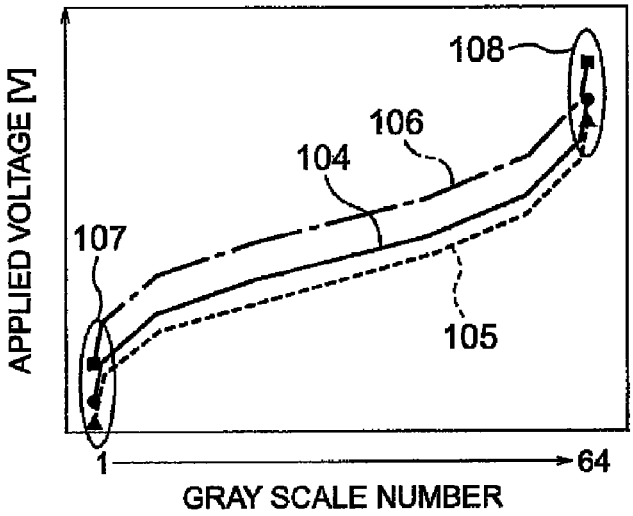

FIG. 1C is a characteristic curve showing the relationship between gray scale number and applied voltage when the number of gray scale levels is set to 64. The applied voltage-brightness characteristic shown in FIGS. 1A, 1B, and 1C varies from one liquid crystal display panel to another liquid crystal display panel. When an applied voltage is adjusted such that $\gamma$ becomes equal to 2.2, for example, an adjusted value of the applied voltage becomes different according to each of the liquid crystal display panels. A curve indicated by reference numeral 104 in FIG. 1C shows the relationship between gray scale number and applied voltage when $\gamma=2.2$. Curves indicated by reference numerals 105 and 106 show relationships between gray scale number and applied voltage when $\gamma=2.2$ in liquid crystal display panels different from the one for the curve 104. As described above, in a liquid crystal display apparatus, a gray scale voltage generating circuit becomes necessary that can adjust an applied voltage, which will be referred to as a gray scale voltage, according to the characteristic of each liquid crystal display panel so as to obtain a desired gamma characteristic.

In order to allow adjustment to voltages of the gray scale levels at the two ends, the present invention is configured to have a resistance ladder. In this configuration, variable resistances are disposed at both ends of the resistance ladder. A reference voltage is externally supplied to one of the ends and the other end is coupled to ground. Voltages of the gray scale levels at the two ends such as the ones indicated by reference numerals 107 and 108 in FIG. 1C are generated by resistive voltage division using the variable resisters. Further, it is arranged such that a register, which will be referred to as an amplitude adjustment register, can set the resistance values of the variable resisters, and that offset adjustment which was conventionally made by an amplifier circuit was also made possible by the resistance ladder.

The present invention is not limited to this arrangement, and is configured to have the resistance ladder by which other voltages of gray scale levels than the ones of gray scale levels at the two ends can also be adjusted by register settings. The contents of the adjustments will be explained with reference to FIGS. 2A, 2B, and 2C.

Figure 2A:
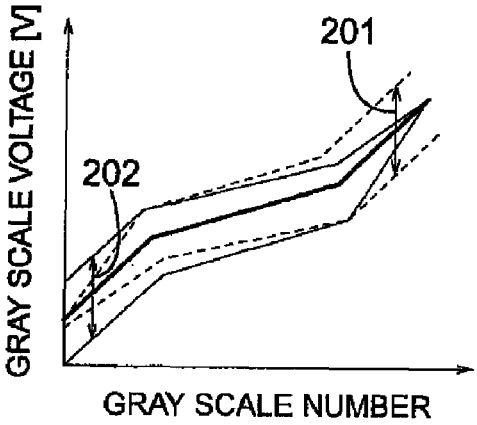
FIGS. 2A, 2B, 2C and 2D are characteristic curves showing adjustments to the gamma characteristic according to the present invention.
Figure 2B:
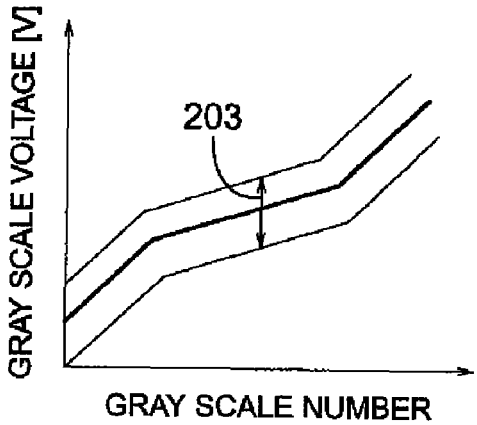

FIG. 2A shows gray scale number-vs.-gray scale voltage characteristics in the cases where the resistance values of the variable resistances at both ends of the resistance ladder have been set by the amplitude adjustment register. Dotted lines indicated by reference numeral 201 show the characteristics where an amplitude voltage adjustment to gray scale voltages is made such that the gray scale voltage of the highest scale level is changed without changing the gray scale voltage of the lowest gray scale level. Solid lines indicated by reference numeral 202 show the characteristics where the amplitude voltage adjustment to the gray scale voltages is made such that the gray scale voltage of the lowest scale level is changed without changing the gray scale voltage of the highest gray scale level. Both of the characteristic lines 201 and 202 show the cases where one of the variable resisters at both ends of the resistance ladder or the variable resisters on both of the reference voltage side and the ground side of the resistance ladder has been set by the amplitude adjustment register. Solid lines indicated by reference numeral 203 on FIG. 2B show characteristics where the variable voltages at both ends of the resistance ladder have been simultaneously set by the amplitude adjustment register. In this case, the same effect as in the case of offset adjustment that was made by the amplifier circuit can be obtained.

Figure 2C:
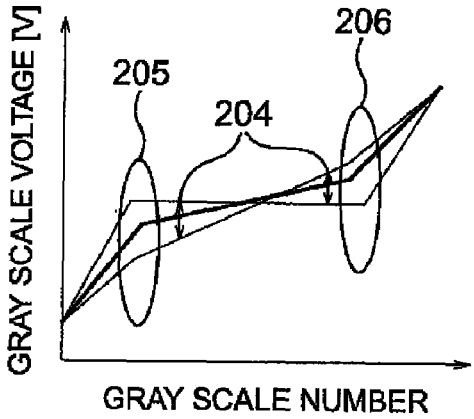

Next, solid lines indicated by reference numeral 204 in FIG. 2C show gray scale number-gray scale voltage characteristics where the gradient characteristic of voltages of intermediate gray scale levels is adjusted. This adjustment can be made by the gradient adjustment register. This register allows setting of the resistance values of the variable resisters that generate gray scale voltages 205 and 206 that determine the gradient characteristic in the resistance ladder.

As described above, gray scale voltages indicated by the curves 104 to 106 in FIG. 1D in accordance with the characteristics of respective liquid crystal display panels can be roughly set by the amplitude adjustment register and the gradient adjustment register. Adjustment to obtain a desired gamma characteristic according to the characteristics of respective liquid crystal display panels can be thereby facilitated, so that an adjustment time can be shortened.

Figure 2D:
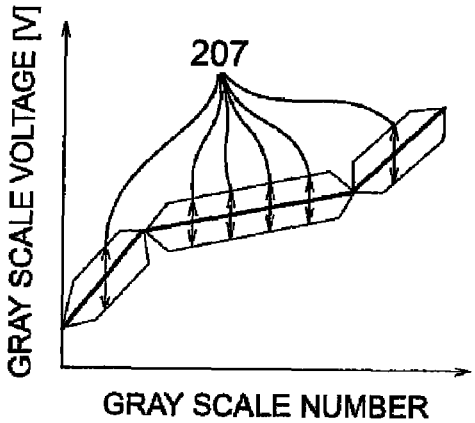

Next, solid lines indicated by reference numeral 207 in FIG. 2D show gray scale number-gray scale voltage characteristics where respective gray scale voltages are micro adjusted. This micro adjustment becomes possible by providing resistive voltage dividing circuits for further dividing the respective voltages of gray scale levels resistive-voltage-divided by one or a plurality of the variable resisters and then allowing a desired gray scale voltage to be selected from among the voltages generated by the resistive voltage division according to a setting in a micro adjustment register. With this arrangement, even if a single variable resistance value is changed, which is the case where the problem described above would occur, respective gray scale voltages resistive-voltage-divided by this variable resister are further resistive-voltage-divided to select a desired voltage. Only the desired gray scale voltage can be thereby adjusted with no other gray scale voltages changed so much. Further, by allowing the micro adjustment of respective gray scale voltages, adjustment to the gamma characteristic can be made with higher accuracy, so that higher image quality can be effected.

As described above, the present invention is configured to have a resistance ladder. With this configuration, when adjustment to the gamma characteristic is made, rough gray scale adjustment such as amplitude voltage adjustment to the gray scale voltages and the gradient characteristic adjustment to the voltages of intermediate gray scale levels according to the characteristics of respective liquid crystal display panels can be made by using settings of the amplitude register and the gradient register. Adjustment to the gamma characteristic can be thereby facilitated, so that an adjustment time can be shortened. Further, by providing the micro adjustment register, micro adjustment to the gray scale voltages which have been adjusted by the amplitude adjustment register and the gradient adjustment register can be further made. Adjusting accuracy can be thereby improved, so that high image quality can be effected. Still further, a degree of freedom in an adjustment range is increased. Thus, versatility of adjustment is obtained.

A configuration of a liquid crystal display apparatus according to a first embodiment of the present invention will be described with reference to FIGS. 3 to 10.

Figure 3:
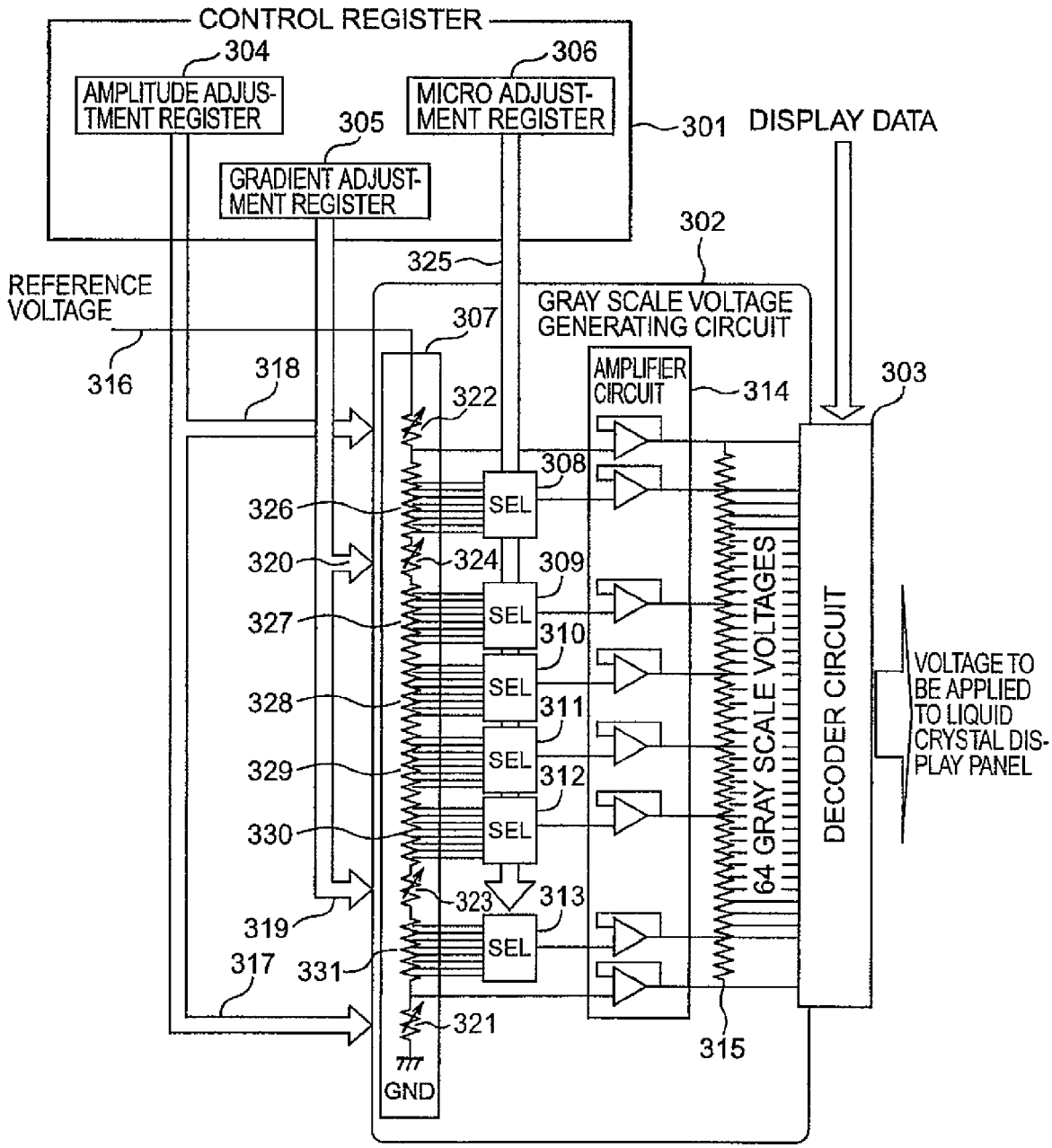
FIG. 3 is a block diagram showing a configuration of a gray scale voltage generating circuit according to a first embodiment of the present invention.

FIG. 3 is a block diagram showing a configuration of a gray scale voltage generating circuit according to the present invention. Reference numeral 301 denotes a control register for holing settings for adjusting the gamma characteristic, reference numeral 302 denotes the gray scale voltage generating circuit, and reference numeral 303 denotes a decoder circuit for decoding a gray scale voltage corresponding to display data. The control register 301 constitutes an amplitude adjustment register 304, a gradient adjustment register 305, and a micro adjustment register 306, described above. Incidentally, the values in the control register 301 may also be stored in a non-volatile memory in a CPU to which the liquid crystal display apparatus is connected.

The gray scale voltage generating circuit 302 constitutes a resistance ladder 307 disposed between the sides of a reference voltage 316 externally supplied and GND, for generating voltages of gray scale levels, variable resisters 321 to 324 and resistive voltage division circuits 326 to 331 for further dividing voltages with resistance divided by the variable resisters, all of which constitutes the resistance ladder 307, selector circuits 308 to 313 for selecting a gray scale voltage generated by the resistive voltage dividing circuits 326 to 331 according to a setting in the micro adjustment register 306, an amplifier circuit 314 for buffering the output voltage of the respective selector circuits, and an output unit resistance ladder 315 for dividing the output voltage with resistance divided of the amplifier circuit 314 into a desired number of gray scale levels (herein 64) of voltages.

The lower variable resistance 321 disposed at the bottom of the resistance ladder 307 is configured to allow setting of its resistance value according to a lower variable resistance setting 317 set in the amplitude adjustment register 304. The upper variable resister 322 disposed on the top of the resistance ladder 307 is configured to allow setting of its resistance value according to an upper variable resistance setting 318 set in the amplitude adjustment register 304. Then, it is arranged such that the voltages divided by the variable resisters 321 and 322 are set to the voltages of the gray scale levels at the two ends, and amplitude adjustment of a gray scale voltage can be set by the amplitude adjustment register 304. The lower variable resister 321 is connected to the GND side in series, being closer to the GND side than the resistive voltage dividing circuit 331 and the lowest level of the gray scale voltage. The upper variable resister 322 is connected to the side of the reference voltage 316 in series, being closer to the side of the reference voltage 316 than the resistive voltage dividing circuit 326 and the highest level of the gray scale voltage. That is, the lower variable resister 321 and the upper variable resister 322 are disposed outside the resistive voltage dividing circuits. When the gray scale voltage amplitude is reduced by the variable resisters 321 and 322, power dissipation can be reduced. For this purpose, either one of the variable resisters 321 and 322 may be employed.

The lower-middle variable resister 323 disposed in the lower position from the middle of the resistance ladder 307 is configured to allow setting of its resistance value according to a lower-middle variable resistance setting set in the gradient adjustment register 305. The upper-middle variable resister 324 disposed in the upper position from the middle of the resistance ladder 307 is configured to allow setting of its resistance value according to an upper-middle variable resistance setting set in the gradient adjustment register 305. The voltages divided by both of the variable resisters 323 and 324 with the resistance divided are set to voltages of gray scale levels that determine the gradient characteristic of the voltages of intermediate gray scale levels, and it is arranged such that the gray scale voltage gradient characteristic can be set by the gradient adjustment register 305. The variable resisters 319 and 320 are connected with the resistive voltage dividing circuits in series. Even if the variable resistance settings 319 of the variable resister 323 and the variable resistance setting 320 of the variable resister 324 change, the gray scale voltage amplitude is not affected so much. By adjusting both of the variable resisters 323 and 324, the contrast of an image can be improved. For this purpose, either one of the variable resisters 323 and 324 may be employed.

By configuring the gray scale voltage generating circuit to have the resistance ladder as described above and setting variable resistance values in the resistance ladder by means of the amplitude adjustment register 304 and the gradient adjustment register 305, a resistive voltage division ratio can be changed, so that the amplitude voltage adjustment to the gray scale voltages and the gradient characteristic adjustment to the voltages of the intermediate gray scale levels can be adjusted. Details of these operations will be described later.

Gray scale voltages generated according to the variable resistance values set in the amplitude adjustment register 304 and the gradient adjustment register 305 are further divided by the resistive voltage dividing circuits 326 to 331 with the resistance divided to generate micro-adjustment gray scale voltages to which micro adjustment is made. Next, the micro-adjustment gray scale voltages are supplied to the selector circuits 308 to 313 to select a desired gray scale voltage according to a setting 325 set in the micro adjustment register 306. With this arrangement, micro adjustment to the respective gray scale voltages can be made, and the accuracy of adjustment to the gamma characteristic can be improved, so that the degree of freedom of adjustment is also improved. Details of this operation will be described later.

The respective gray scale voltages generated as described above are buffered at the amplifier circuit 314 in a subsequent stage. Then, in order to generate desired voltages of 64 gray scale levels, the gray scale voltages are divided by the output unit resistance ladder 315 with the resistance divided so as have a linear relationship to one another, and thereby the 64 gray scale voltages are generated. With this arrangement, among the 64 gray scale voltages generated by the gray scale voltage generating circuit 302, a gray scale voltage corresponding to display data is decoded to become an applied voltage to the liquid crystal display panel.

The circuit as described above constitutes a resistance ladder that can make rough gray scale voltage adjustments such as the amplitude voltage adjustment to the gray scale voltages and the gradient characteristic adjustment to the voltages of intermediate gray scale levels by using settings in the amplitude adjustment register 304 and the gradient adjustment register 305, when the gamma characteristic is adjusted. Then, it is arranged such that micro adjustment to the respective gray scale voltages generated by the resistance ladder can be further made according to a setting in the micro adjustment register 306. Adjustment to the gamma characteristic can be thereby facilitated, so that an adjustment time can be shortened. Then, the adjusting accuracy and the degree of freedom of adjustment are improved, so that a small-sized gray scale voltage generating circuit that can effect high image quality and versatility is thereby realized at a low cost.

Next, the settings in the registers and the operations of the variable resisters 321 to 324 in FIG. 3 according to this embodiment will be described with reference to FIGS. 4A, 4B, and 4C. Reference numeral 401 shows the internal configuration of the variable resister 321, 322, 323, or 324. The variable resisters 321 to 324 herein are configured such that for each decrease of bit in settings in the registers which are the amplitude adjustment resister 304 and the gradient adjustment register 305, the resistance is incremented by 4R, where R indicates a unit of resistance. If a setting in the register is "111"[BIN] as indicated by reference numeral 402, switches 403 to 405 connected to the terminals of the resisters in the variable resister 401 are switched ON, thereby bringing the variable resister 401 into a short-circuited state. Accordingly, the total resistance of the variable resister 401 becomes 0R. Incidentally, the switches 403 to 405 are controlled on a bit-to-bit basis of a setting in the register; the switch 403 is controlled to be switched ON or OFF according to the second bit of a setting in the register, the switch 404 is controlled to be switched ON or OFF according to the first bit of the setting in the register, and the switch 405 is controlled to be switched ON or OFF according to the zeroth bit of the setting of the register. Next, if a setting in the register is "000"[BIN] as indicated by reference numeral 406, the switches 403 to 405 connected to the terminals of the resistances in the variable resister 401 are switched OFF. The total resistance of the variable resister 401 becomes the sum of the resistances inside the variable resister, or 28R. The relationship between setting of the register and variable resister value in the above-described circuit configuration becomes the one shown in the table indicated by reference numeral 407.

The relationship between setting in the register and variable resistance value is just an example for setting. If the respective bits of a setting in the register are inverted, the relationship between setting of the register and variable resistance value becomes inverted; if a setting in the register increases, the resistance value of the variable resister also increases. The relationship between setting in the register and variable resister may also be inverted, as described above. The change ratio of a variable resistance value with respect to a setting in the register is herein set to 4R for each setting. The change ratio may also be smaller or larger than 4R. If the change ratio of a variable resistance value for each setting in the register is decreased, the accuracy of adjustment is improved. However, the range of adjustment becomes smaller. Conversely, if the change ratio of a variable resistance value for each setting in the register is increased, the adjustment range becomes more extended. However, the accuracy of adjustment deteriorates. Preferably, the resistance unit R constitutes several tens of kiloohms, because current dissipation can be reduced. Though the number of bits of a setting in the register described above is set to three bits, the number of the bits of the setting may be increased. In this case, though the adjustment range increases, the size of the gray scale voltage generating circuit increases.

With the arrangement described above, the resistance values of the variable resisters can be changed according to a setting in the register.

Next, adjustment operations of the gamma characteristic by the amplitude adjustment register 304 and the variable resisters 321 and 322 in the resistance ladder 307 in FIG. 3 will be described with reference to FIGS. 5A, 5B, and 5C.

Figure 5A:
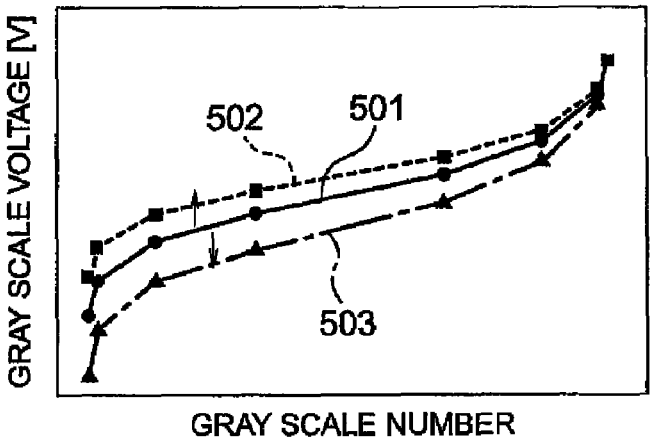
FIGS. 5A, 5B, and 5C are characteristic curves showing adjustment operations of the gamma characteristic using settings of an amplitude adjustment register according to the present invention.

FIG. 5A shows an adjustment operation when the resistance value of the lower variable resister 321 in the resistance ladder 307 in FIG. 3 is set by the amplitude adjustment register 304. A solid line indicated by reference numeral 501 shows a gray scale number-gray scale voltage characteristic when the amplitude adjustment register 304 is set to a default setting. If the gray scale voltage of the lowest gray scale level is to be changed without changing the gray scale voltage of the highest gray scale level to make amplitude adjustment to the gray scale voltages to a small degree, as shown by a dotted line indicated by reference numeral 502, a setting in the amplitude adjustment register 304 should be set such that the resistance value of the lower variable resister 321 becomes large. If the gray scale voltage of the lowest gray scale level is to be changed without changing the gray scale voltage of the highest gray scale level to make amplitude adjustment to the gray scale voltages to a great degree, as shown by a dotted line indicated by reference numeral 503, a setting in the amplitude adjustment register 304 should be set such that the resistance value of the lower variable resister 321 becomes small.

By changing the resistance value of the lower variable resister 321 according to a setting in the amplitude adjustment register 304 in this manner, the gray scale voltage of the lowest gray scale level can be changed without changing the gray scale voltage of the highest gray scale level, thereby allowing amplitude adjustment to the gray scale voltages.

Figure 5B:
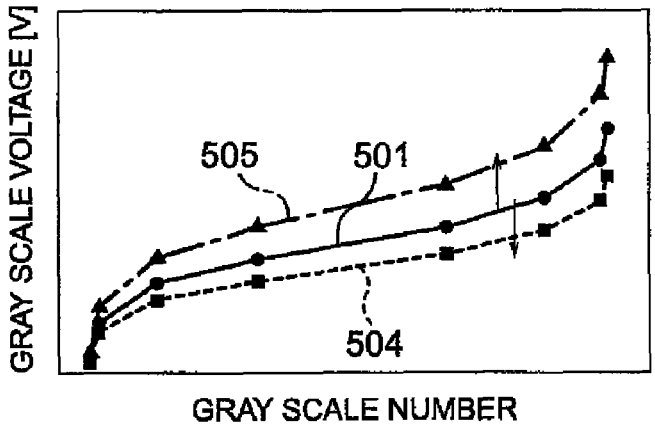

Next, FIG. 5B shows an adjustment operation when the resistance value of the upper variable resister 322 in the resistance ladder 307 in FIG. 3 is set by the amplitude adjustment register 304. As described above, the solid line 501 in FIG. 5B shows the gray scale number-gray scale voltage characteristic when the amplitude adjustment register 304 is set to the default setting. If the gray scale voltage of the highest scale level is to be changed without changing the gray scale voltage of the lowest gray scale level as shown in a dotted line indicated by reference numeral 504 to make amplitude adjustment to the gray voltages to a small degree, a setting in the amplitude adjustment register 304 should be set such that the resistance value of the upper variable resister 322 becomes large. If the gray scale voltage of the highest gray scale level is to be changed without changing the gray scale voltage of the lowest gray scale level as shown by a dotted line indicated by reference numeral 505 to make amplitude adjustment to the gray scale voltages to a great degree, a setting in the amplitude adjustment register 304 should be set such that the resistance value of the upper variable resister 322 becomes small.

By changing the resistance value of the upper variable resister 322 according to a setting in the amplitude adjustment register 304 in this manner, the gray scale voltage of the highest gray scale level can be changed without changing the gray scale voltage of the lowest gray scale level, so that amplitude voltage adjustment to the gray scale voltages can be made.

Figure 5C:
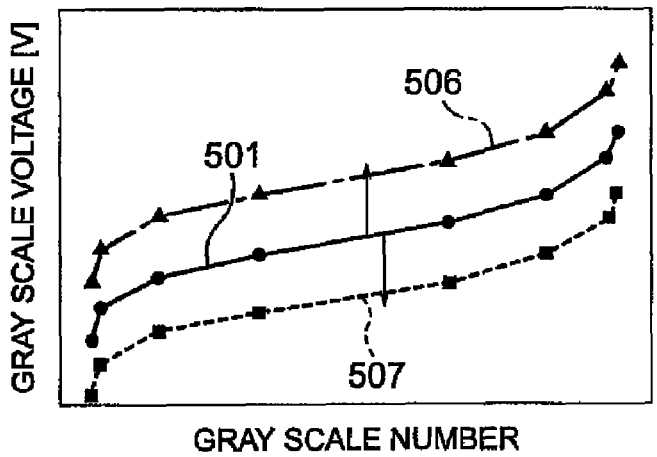

Next, FIG. 5C shows an adjustment operation when the resister values of the lower variable resister 321 and the upper variable resister 322 are simultaneously set by the amplitude adjustment register 304. As described above, the solid line 501 in FIG. 5C shows the gray scale number-gray scale voltage characteristic when the amplitude adjustment register 304 is set to the default setting. If the gray scale voltages of the highest and lowest gray scale levels are to be increased with the gray scale number-gray scale voltage characteristic and the amplitude voltage kept to be the same as those in the case of the solid line 501, as shown in a dotted line indicated by reference numeral 506, a setting in the amplitude adjustment register 304 should be set such that the resistance value of the lower variable resister 321 becomes large and the resistance value of the upper variable resister 322 becomes small. Further, if the gray scale voltages of the highest and lowest gray scale levels are to be decreased with the gray scale number-gray scale voltage characteristic and the amplitude voltage kept to be the same as the ones indicated by the solid line 501, as shown in a dotted line indicated by reference numeral 507, a setting in the amplitude adjustment register 304 should be set such that the resistance value of the lower variable resister 321 becomes small and the resistance value of the upper variable resister 322 becomes large.

If the resistance values of the lower and upper variable resisters 321 and 322 are simultaneously set according to a setting in the amplitude adjustment register 304 in this manner, the characteristic becomes the one obtained by making offset adjustment to the gray scale number-gray scale voltage characteristic when the amplitude adjustment register 304 is set to the default setting.

As described above, the amplitude adjustment register 304 in FIG. 3 can make amplitude voltage adjustment to the gray scale voltages according to the characteristics of respective liquid crystal display panels.

Next, adjustment operations of the gamma characteristic using the gradient adjustment register 305 and the variable resisters 323 and 324 in the resistance ladder 307 in FIG. 3 will be described with reference to FIGS. 6A, 6B, and 6C.

Figure 6A:
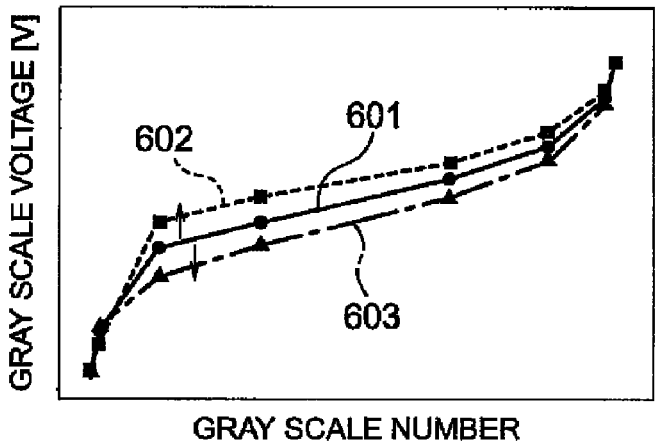
FIGS. 6A, 6B, and 6C are characteristic curves showing adjustment operations of the gamma characteristic using settings of a gradient adjustment register according to the present invention.

FIG. 6A shows an adjustment operation when the resistance value of the lower-middle variable resister 323 in the resistance ladder 307 in FIG. 3 is set by the gradient adjustment register 305. A solid line indicated by reference numeral 601 shows a gray scale number-gray scale voltage characteristic when the gradient adjustment register 305 is set to a default setting. As shown in a dotted line indicated by reference numeral 602, if the gray scale voltages of low gray scale levels are to be changed without changing the gradient characteristic of the gray scale voltages of high gray scale levels to make adjustment such that the gradient of the gray scale voltages of intermediate gray scale levels is reduced, a setting in the gradient adjustment register 305 should be set such that the resistance value of the lower-middle variable resister 323 becomes large.

As shown in a dotted line indicated by reference numeral 603, if the gray scale voltages of low gray scale levels are to be changed without changing the gradient characteristic of the gray scale voltages of high gray scale levels to make adjustment such that the gradient of the gray scale voltages of intermediate gray scale levels is increased, a setting in the gradient adjustment register 305 should be set such that the resistance value of the lower-middle variable resister 323 becomes small.

By changing the resistance value of the lower-middle variable resister 323 according to a setting in the gradient adjustment register 305 in this manner, the gray scale voltages of low gray scale levels can be changed without changing the gradient characteristic of the gray scale voltages of high gray scale levels, so that the gradient of the gray scale voltages of intermediate gray scale levels can be adjusted.

Figure 6B:
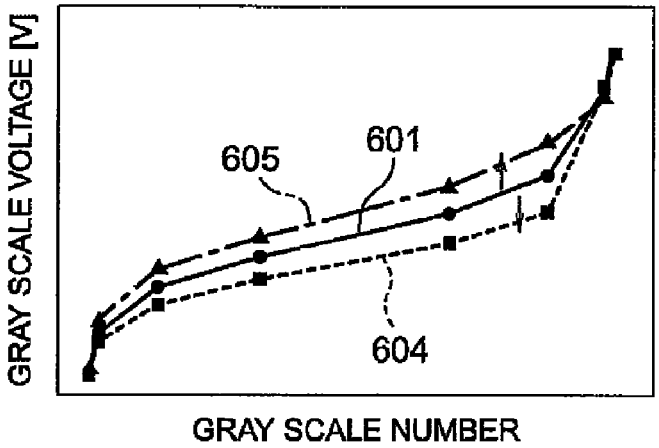

Next, FIG. 6B shows an adjustment operation when the resistance value of the upper-middle variable resister 324 in the resistance ladder 307 in FIG. 3 is set by the gradient adjustment register 305. As described above, the line 601 shows the gray scale number-gray scale voltage characteristic when the gradient adjustment register 305 is set to the default setting. As shown in a dotted line indicated by reference numeral 604, if the gray scale voltages of high gray scale levels are to be changed without changing the gradient characteristic of the gray scale voltages of low gray scale levels to make adjustment such that the gradient of the gray scale voltages of intermediate gray scale levels is reduced, a setting in the gradient adjustment register 305 should be set such that the resistance value of the upper-middle variable resister 324 becomes large. Further, as shown in a dotted line indicated by reference numeral 605, if the gray scale voltages of high gray scale levels are to be changed without changing the gradient characteristic of the gray scale voltages of low gray scale levels to make adjustment such that the gradient of the gray scale voltages of intermediate gray scale levels becomes large, a setting in the gradient adjustment register 305 should be set such that the resistance value of the upper-middle variable resister 324 becomes small.

By changing the resistance value of the upper-middle variable resister 324 according to a setting in the gradient adjustment register 305, the gray scale voltages of high gray scale levels can be changed, so that the gradient of the gray scale voltages of intermediate gray scale levels can be adjusted.

Figure 6C:
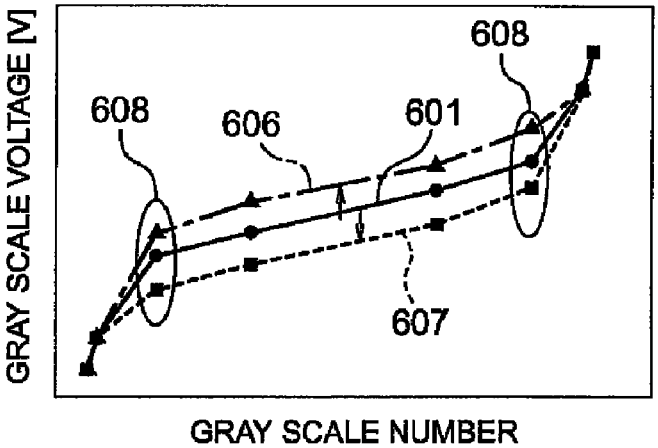

FIG. 6C shows an adjustment operation when the resistance values of the lower-middle variable resister 323 and the upper-middle variable resister 324 are simultaneously set by the gradient adjustment register 305. As described above, the line 601 shows the gray scale number-gray scale voltage characteristic when the gradient adjustment register 305 is set to the default setting. As shown in a dotted line indicated by reference numeral 606, if the gradient characteristic is to be the same as that of the line 601 and gray scale voltages 608 that determine the gradient characteristic are to be increased, a setting in the gradient adjustment register 305 should be set such that the resistance value of the lower-middle variable resister 323 is large and the resistance value of the upper-middle variable resister 324 is small. Further, as shown in a dotted line indicated by reference numeral 607, if the gradient characteristic is to be the same as that of the line 601 and the gray scale voltages 608 that determine the gradient characteristic are to be reduced, a setting in the gradient adjustment register 305 should be set such that the resistance value of the lower-middle variable resister 323 is small and the resistance value of the upper-middle variable resister 324 is large.

If the resistances of the lower-middle resister 323 and the upper-middle variable resister 324 are simultaneously set according to a setting in the gradient adjustment register 305, the gradient characteristic of the gray scale number-gray scale voltage remains the same as the characteristic when the gradient adjustment register 305 is set to the default setting. However, the voltage values of the gray scale voltages 608 that determine the gradient characteristic are adjusted.

As described above, the gradient adjustment register 305 in FIG. 3 can adjust only the gradient characteristic of the gray scale voltages of intermediate gray scale levels according to the characteristics of respective liquid crystal display panels, with no amplitude voltage change in the gray scale voltages.

Next, the relationship between setting in the micro adjustment register 306 and the selector circuits 308 to 313 in FIG. 3 according to this embodiment will be described with reference to FIGS. 7A, 7B, and 7C.

Figures 7A, 7B:
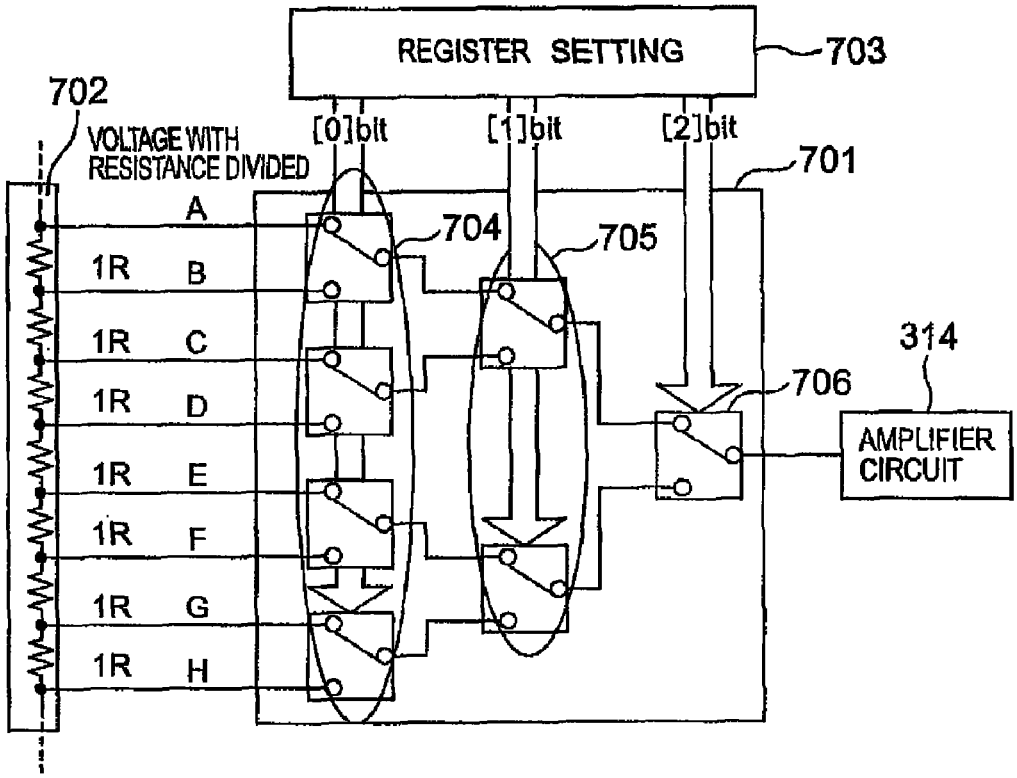
FIGS. 7A and 7B are a block diagram showing a configuration of a selector circuit, showing a relationship between a register setting value and a resistance divided voltage according to the first embodiment of the present invention, respectively.

Referring to FIG. 7A, reference numeral 701 denotes one of the selector circuits 308 to 313, the internal configuration of which is shown. Reference numeral 702 denotes one of the resistive voltage dividing circuits 326 to 331 in the resistance ladder 307 in FIG. 3, the internal configuration of which is shown. FIG. 7A shows a configuration in which resistive voltage division with a resistance value of 1R is performed to generate eight micro adjustment gray scale voltages A to H. The selector circuit 701 selects one of the micro adjustment gray scale voltages A to H generated by the resistive voltage dividing circuit 702 according to a setting 703 in the micro adjustment register 306.

The selector circuit 701 comprises two-input one-output selector circuits, and selects the output of a selector circuit in a first-stage selector circuit group 704 according to the zeroth bit of the register setting 703, selects the output of a selector circuit in a second stage selector circuit group 705 according to the first bit of the register setting 703, and selects an output in a third-stage selector circuit 706 according to the second bit of the register setting 703.

If the register setting 703 is set to "000" [BIN], the selector circuit 701 supplies the micro adjustment gray scale voltage A divided by the resistive voltage dividing circuit 702 with the resistance divided. If the register setting 703 is set to "111" [BIN], the selector circuit 701 supplies the micro adjustment gray scale voltage H divided by the resistive voltage division circuit 702 with the resistance divided. In this way, for each increase of bit in the register setting 703 in the micro adjustment register 306, the selector circuit 701 sequentially selects one of the micro adjustment gray scale voltages A to H, each divided by the resistive voltage dividing circuit 702 with the resistance divided. The relationship between the register setting 703 and the micro adjustment gray scale voltages A to H selected by the selector circuit 701 is shown in a table indicated by reference numeral 707.

The relationship between a register setting and the selector circuit is just an example. If the respective bits of a register setting are inverted, the relationship between the register setting and the selector circuit is inverted. If the register setting increases, the selector circuit sequentially selects one of the micro adjustment gray scale voltages H to A in this stated order. As described above, the relationship between register setting and variable resistance may also be inverted.

The number of bits of a setting in the register for the selector circuit described above is three bits, and the selector circuit selects one of the eight micro adjustment gray scale voltages. The number of the bits of a setting may be increased to increase the number of selectable gray scale levels. In this case, a gray scale voltage micro adjustment range becomes more extended. However, the size of the gray scale voltage generating circuit increases. Further, although the resistance value used for resistive voltage division in the resistive voltage dividing circuit is set to 1R, this value may be set to be smaller or larger. If the resistance value is reduced, the micro adjustment range becomes narrower. However, the adjusting accuracy is improved. If the resistance value is increased, the micro adjustment range becomes more extended, but the adjusting accuracy deteriorates. Further, like the variable resisters in FIG. 4A, preferably, the unit resistance R constitutes several tens of kiloohms, because power dissipation can be thereby reduced.

Next, adjustment to the gamma characteristic by the micro adjustment register 306 and the selector circuits 308 to 313 in FIG. 3 will be described with reference to FIG. 8.

Figure 8:
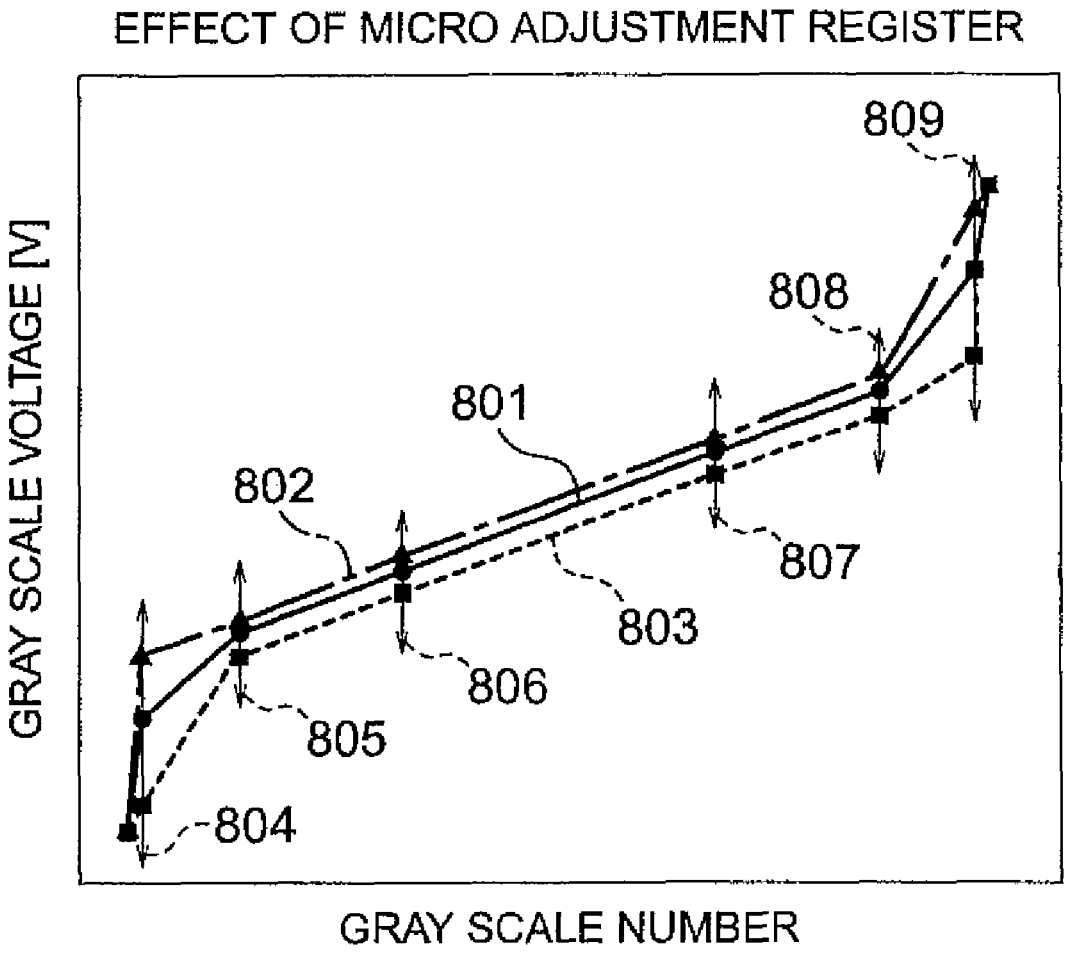
FIG. 8 is a characteristic curve showing an adjustment operation of the gamma characteristic using settings of a micro adjustment register according to the present invention.

Referring to FIG. 8, a solid line indicated by reference numeral 801 shows a gray scale number-gray scale voltage characteristic when the micro adjustment register 306 is set to a default setting. A dotted line indicated by reference numeral 802 shows a characteristic when a setting in the micro adjustment register 306 is set such that the voltage value selected by the selector circuits 308 to 313 is maximized. A dotted line indicated by reference numeral 803 shows a characteristic when a setting in the micro adjustment register 306 is set such that the voltage value selected by the selector circuits 308 to 313 is minimized. Accordingly, the voltages in a region from the dotted line 802 to the dotted line 803 constitute the range of gray scale voltages that can be set for micro adjustment by the micro adjustment register 306. Reference numerals 804 to 809 denote the outputs of the selector circuits 308 to 313 or the gray scale voltages that can be micro adjusted, and they can be micro adjusted within the range of the gray scale voltages from the dotted line 802 to the dotted line 803.

As described above, according to a setting in the micro adjustment register 306 in FIG. 3, one gray scale voltage is selected from among the gray scale voltages generated by the voltage dividing circuits 326 to 331 in the resistance ladder 307, respectively so as to allow micro adjustment. With this arrangement, micro adjustment to gray scale voltages according to the characteristics of respective liquid crystal display panels becomes possible. The adjusting accuracy is thereby improved, so that high image quality can be effected.

Figure 9:
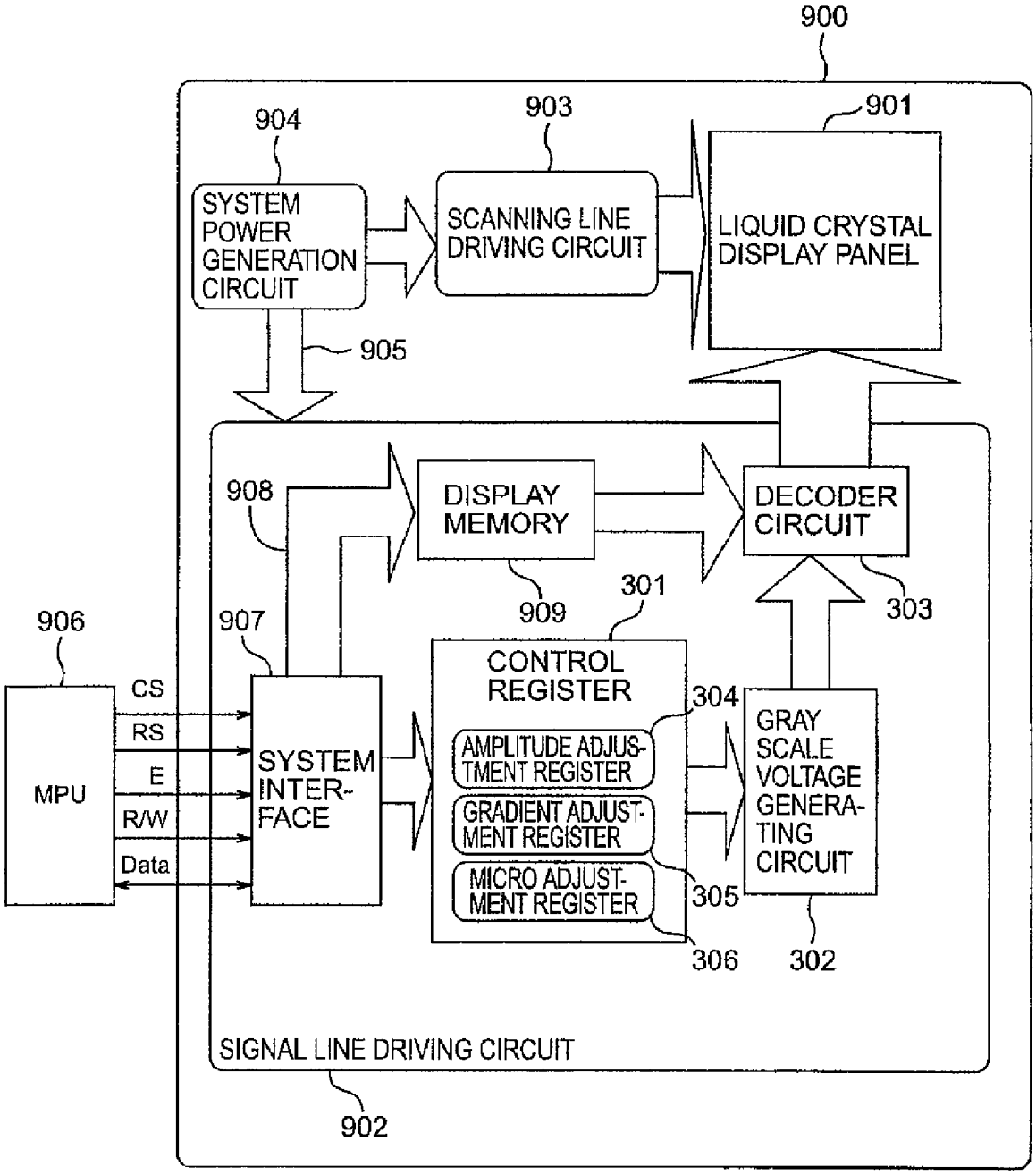
FIG. 9 is a block diagram showing a configuration of a liquid crystal display apparatus system according to a first embodiment of the present invention.

A configuration of a liquid crystal display apparatus system where the gray scale voltage generating circuit that can adjust the gamma characteristic using three types of the adjustment registers is included in a signal line driving circuit will be illustrated in FIG. 9. The three types of the adjustment registers are the amplitude adjustment register, gradient adjustment register, and micro adjustment register described above. Reference numeral 900 denotes the liquid crystal display apparatus according to the present invention. Reference numeral 901 denotes a liquid crystal display panel, reference numeral 902 denotes the signal line driving circuit that includes the gray scale voltage generating circuit 302 in FIG. 3 for supplying a gray scale voltage corresponding to display data to the signal line of the liquid crystal display panel 901. Reference numeral 903 denotes a scanning line driving circuit for scanning scan lines on the liquid crystal display panel 901, reference numeral 904 denotes a system power generation circuit for supplying power for operating the signal line driving circuit 902 and the scanning line driving circuit 903. A supply voltage 905 supplied from the system power generation circuit 904 to the signal line driving circuit 902 includes the reference voltage 316 in FIG. 3. Next, reference numeral 906 is an MPU (micro processor unit) for performing various control and processing for displaying an image on the liquid crystal display panel 901. The signal line driving circuit 902 constitutes a system interface 907 for exchanging display data with the MPU 906 and exchanging data with the control register, a display memory 909 for temporarily storing display data 908 supplied from the system interface 907, and the control register 301, gray scale voltage generating circuit 302, and decoder circuit 303, illustrated in FIG. 3. The control register 301 includes the amplitude adjustment register 304, gradient adjustment register 305, and micro adjustment register 306 illustrated in FIG. 3. The signal line driving circuit 902 and the scanning line driving circuit 903 may also be included in the liquid crystal display 901.

The MPU 906 conforms to the bus interface of the 16-bit bus 68xxx general-purpose MPU family, for example. From the MPU 906, a CS (Chip Select) signal for indicating chip selection, an RS (Register Select) signal for selecting whether an address or data in the control register 301 is specified, an E (Enable) signal for commanding the start of processing, an R/W (Read/Write) signal for selecting data writing or reading, and a Data signal indicating a 16-bit data that represents an actual address or data setting in the control register 301. By means of these control signals, settings in the amplitude adjustment register 304, gradient adjustment register 305, and micro adjustment register 306 are assigned to respective addresses in the control register 301, and data writing and reading operations are performed onto each address in the control register 301 to which setting data is assigned.

Figure 10A:
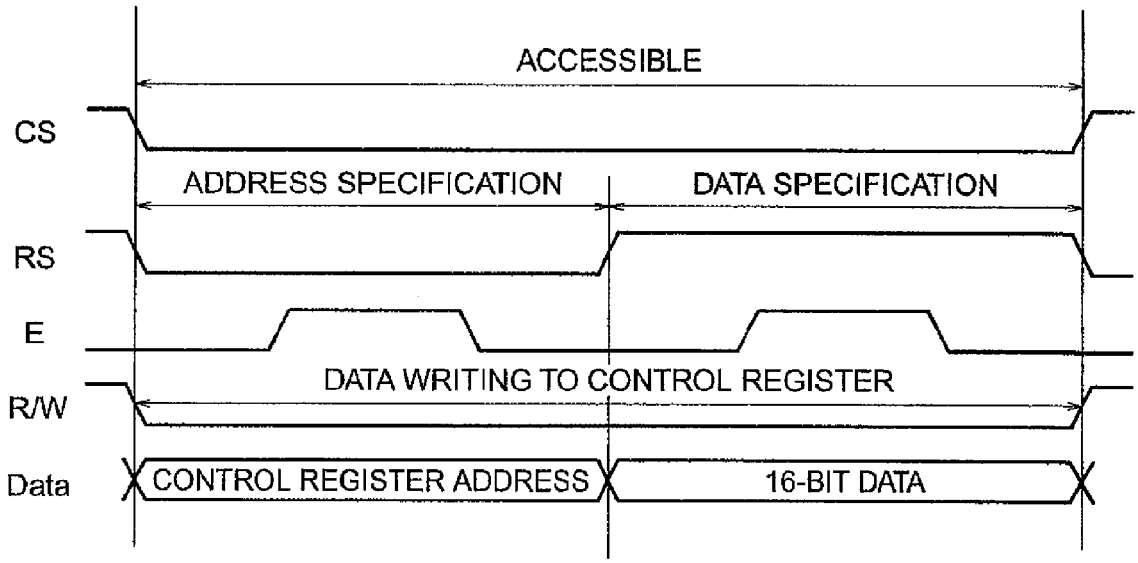
FIGS. 10A and 10B are timing diagrams showing a flow for a register setting according to the present invention.
Figure 10B:
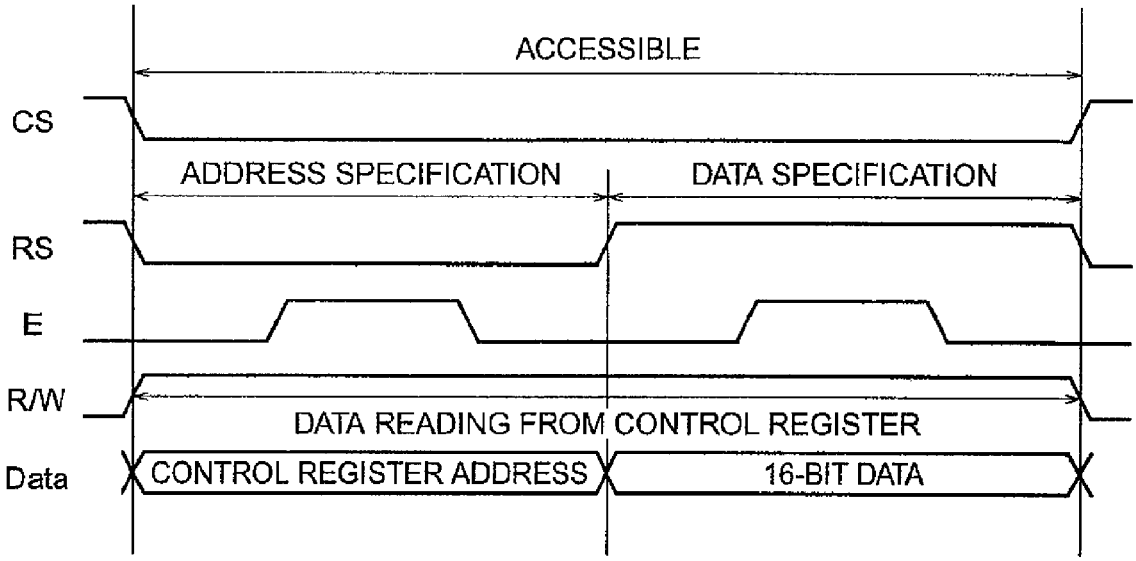

Next, the operations of the control signals supplied from the MPU 906 to the system interface 907 in the signal line driving circuit 902 will be described with reference to FIGS. 10A and 10B. First, the CS signal is set to "Low", and the control register 301 is brought into an accessible state. During the period in which the RS signal is "Low", address specification is performed. During the period in which the RS signal is "High", data specification is performed. If data writing is performed into the control register 301, the R/W signal is held "Low". A predetermined address value is set for the Data signal during the period of address specification. During the period of data specification, data to be written into the register at this address, such as a setting in the amplitude adjustment register 304, gradient adjustment register 305, or micro adjustment register 306, all described above, is set. Thereafter, the E signal is driven "high" for a given period, and data is thereby written into the control register 301.

When reading out data that has been set in the control register 301, the CS signal and the RS signal are set in the same manner as that described above. Then, the R/W signal is held "High". A predetermined address is set during the period of address specification. After this setting, by holding the E signal "High" for the given period, the data written in the register during the period of data specification is read out.

By writing settings in the amplitude adjustment register 304, gradient adjustment register 305, micro adjustment register 306 at the respective assigned addresses in the control register 301, when adjustment to the gamma characteristic is made, amplitude voltage adjustment to the gray scale voltages, gradient characteristic adjustment to the gray scale voltages of intermediate gray scale levels, and micro adjustment become possible. Adjustment to the gamma characteristic is thereby facilitated, and gray scale voltages in accordance with the characteristics of the respective liquid crystal display panels can be thereby set.

Next, a configuration of a liquid crystal display apparatus according to a second embodiment of the present invention will be described.

First, generally, when a gray scale voltage is applied to a liquid crystal display panel, the polarity of the gray scale voltage must be reversed by an alternating current having a given period, which is hereinafter referred to as an M signal, so as to alternating-current drive the liquid crystal display panel.

Figure 11:
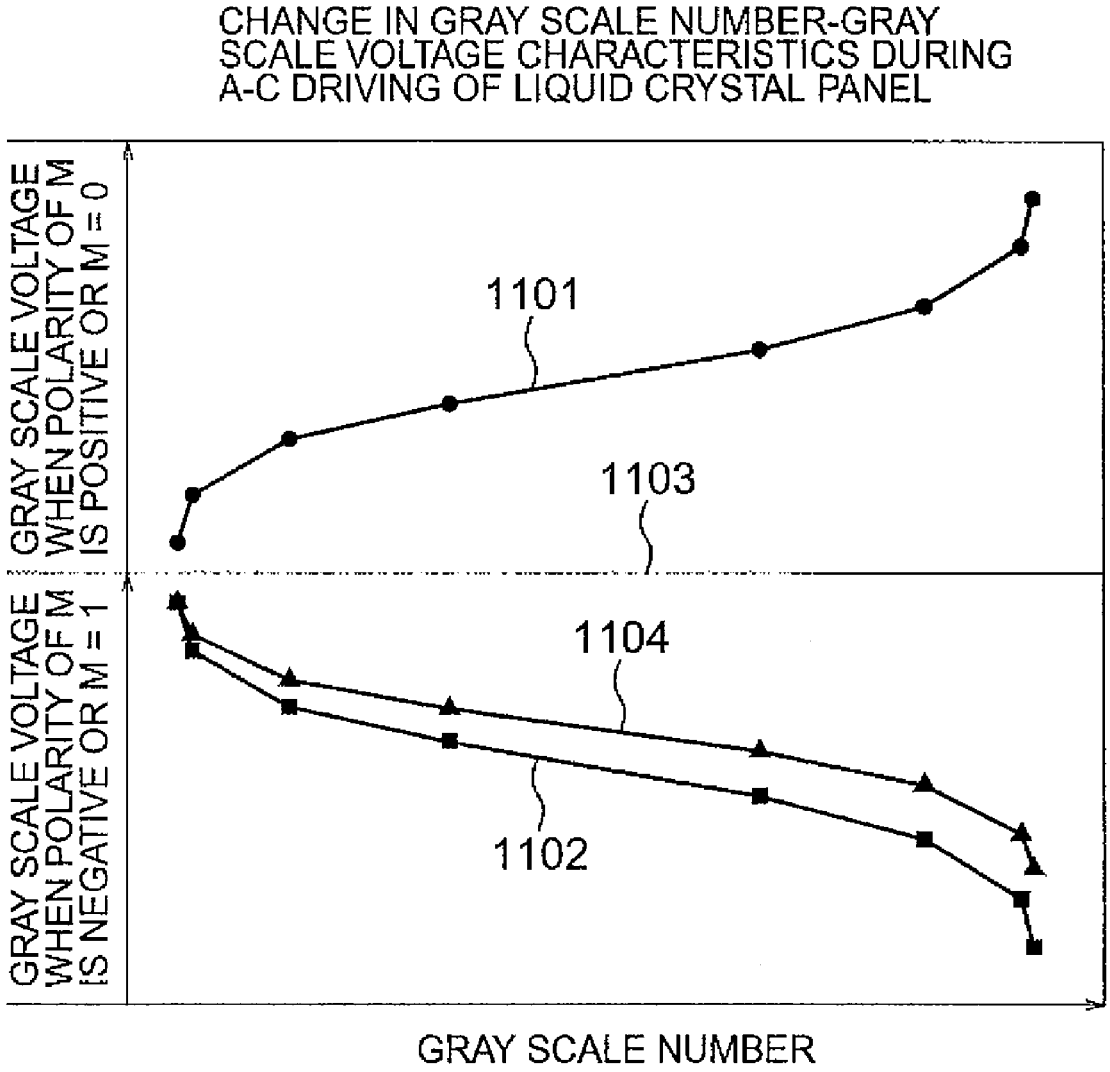
FIG. 11 are characteristic curves showing asymmetrical gamma characteristics of a liquid crystal display panel.

The gray scale number-gray scale voltage characteristic of the liquid crystal display panel also differs according to the polarity of the M signal, and it sometimes happens that adjustment must be made for each polarity of the M signal so as to obtain a desired gamma characteristic. FIG. 11 shows changes in the gray scale number-gray scale voltage characteristics when a liquid crystal display panel is alternating-current driven. A curve indicated by reference numeral 1101 shows a gray scale number-gray scale voltage characteristic when the polarity of the M signal is positive or equals to zero. This curve shows that, when the liquid crystal display panel is in the normally black mode, as the gray scale number increases, the gray scale voltage increases. A curve indicated by reference numeral 1102 shows a gray scale number-gray scale voltage characteristic when the polarity of the M signal is negative or one. This curve shows that, as the gray scale number increases, the gray scale voltage decreases. The curve 1101 and the curve 1102 are symmetrical with respect to a center line 1103. Suppose that the positive and negative gray scale number-gray scale voltage characteristics are symmetrical. Then, if the output order of the 64 gray scale voltages is reversed, or the relationship between gray scale voltage and gray scale number is reversed in such a way that the 64th gray scale voltage is output as the first gray scale voltage and the first gray scale voltage is output as the 64th gray scale voltage, and other gray scale voltages are output in descending order of gray scale numbers in the gray scale voltage generating circuit in FIG. 3, it is not necessary to make adjustment to the gamma characteristic of according to the polarity of the M signal. However, depending on a liquid crystal display panel, there is a case where positive and negative gray scale number-gray scale voltage characteristics are not symmetrical, as shown in a curve indicated by reference numeral 1104. In this case, in the gray scale voltage generating circuit in FIG. 3 according to the first embodiment, setting in the registers must be performed whenever necessary in accordance with the positive or negative gray scale number-gray scale voltage characteristic in order to make adjustment to obtain a desired gamma characteristic. In order to solve the problem described above, in the second embodiment of the present invention, resistance ladders for positive and negative gray scale voltages, which have the same effect as that in the first embodiment are provided separately to allow adjustment to both of the positive and negative gamma characteristics.

A configuration of a liquid crystal display apparatus according to the second embodiment of the present invention will be described with reference to FIG. 12.

Figure 12:
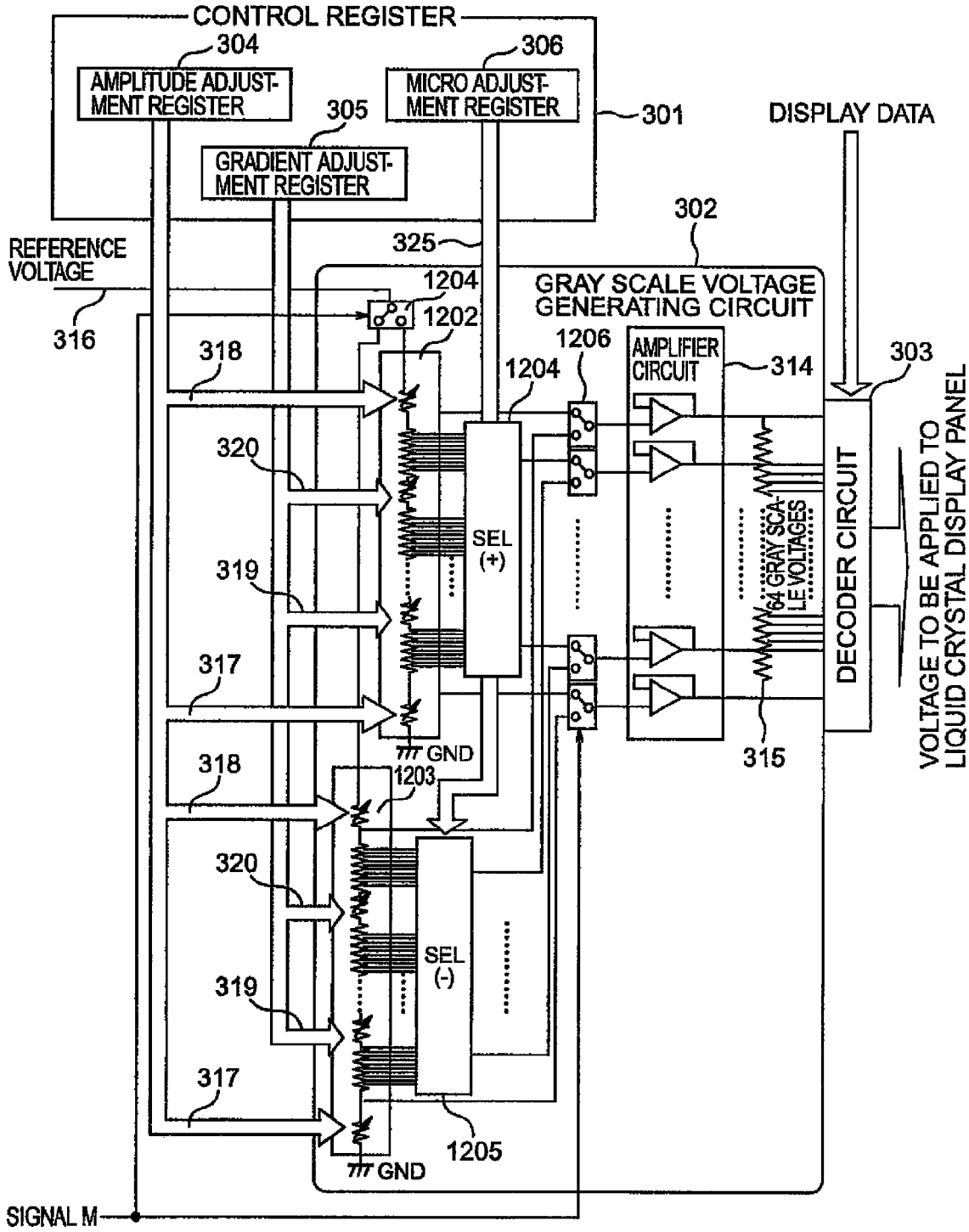
FIG. 12 is a block diagram showing a configuration of a gray scale voltage generating circuit according to a second embodiment of the present invention.

FIG. 12 shows the gray scale voltage generating circuit 302 in FIG. 3 according to the first embodiment, of which only the internal configuration is modified. The configurations and operations of the control register 301 and the decoder circuit 303 are the same as those according to the first embodiment. The gray scale voltage generating circuit 302 in FIG. 12 includes a resistance ladder 1202 for positive gray scale voltages and a resistance ladder 1203 for negative gray scale voltages obtained by dividing the resistance ladder 307 in FIG. 3 according to the first embodiment.

The resistance ladders 1202 and 1203 for positive and negative gray scale voltages are configured such that they can achieve the same effect as the first embodiment according to settings in the amplitude adjustment register 304 and the gradient adjustment register 305.

The resistance ladders 1202 and 1203 for positive and negative gray scale voltages are configured to commonly use settings in the amplitude adjustment register 304 and the gradient adjustment register 305 to allow the same amplitude voltage adjustment to gray scale voltages and the same adjustment to the gradient characteristic as those in the first embodiment by using the settings, according to the polarity of a gray scale voltage. It is arranged such that setting of resistance values in the resistance ladder 1202 for positive gray scale voltages is different from setting of resistance values in the resistance ladder 1203 for negative voltages to allow different gray scale voltage adjustments depending on the polarity of a gray scale voltage according to the settings in the amplitude adjustment register 304 and the gradient adjustment register 305.

Further, as described above, since two resistance ladders 1202 and 1203 for positive and negative gray scale voltages are provided, two types of selector circuits, which are a selector circuit 1204 for positive gray scale voltages and a selector circuit 1205 for negative gray scale voltages become necessary, in place of the selector circuits 308 to 313 in FIG. 3. The selector circuit 1204 for positive gray scale voltages and the selector circuit 1205 for negative gray scale voltages have the same configuration as the selector circuits 308 to 313 in FIG. 3 according to the first embodiment, thus allowing micro adjustment which is the same as that in the first embodiment by using settings in the micro adjustment register 306.

In the gray scale voltage generating circuit 302 having the configuration as described above, polarity selector circuits 1201 and 1206 for performing selection in response to the M signal makes selection between the outputs of the resistance ladders 1202 and 1203 for positive and negative gray scale voltages and the outputs of the selector circuits 1204 and 1205 for positive and negative gray scale voltages according to the polarity of the M signal. When the polarity of the M signal equals to zero, the polarity selectors 1201 and 1206 select the outputs of the resistance ladder 1202 for positive gray scale voltages and the selector circuit 1204 for positive gray scale voltages. When the polarity of the M signal equals to one, the polarity selectors 1201 and 1206 selects the outputs of the resistance ladder 1203 for negative gray scale voltages and the selector circuit 1205 for negative gray scale voltages.

By configuring the gray scale voltage generating circuit as described above, and including this circuit in the liquid crystal display apparatus system that is the same as the liquid crystal display apparatus system in FIG. 9 according to the first embodiment, a liquid crystal display apparatus that can separately adjust gamma characteristics for positive and negative gray scale voltages is realized. Settings in the respective adjustment registers 304 to 306 are assigned to respective addresses in the control register 301 to perform writing of the settings into the respective registers in response to the control signals in FIG. 10 as in the first embodiment.

Figure 13:
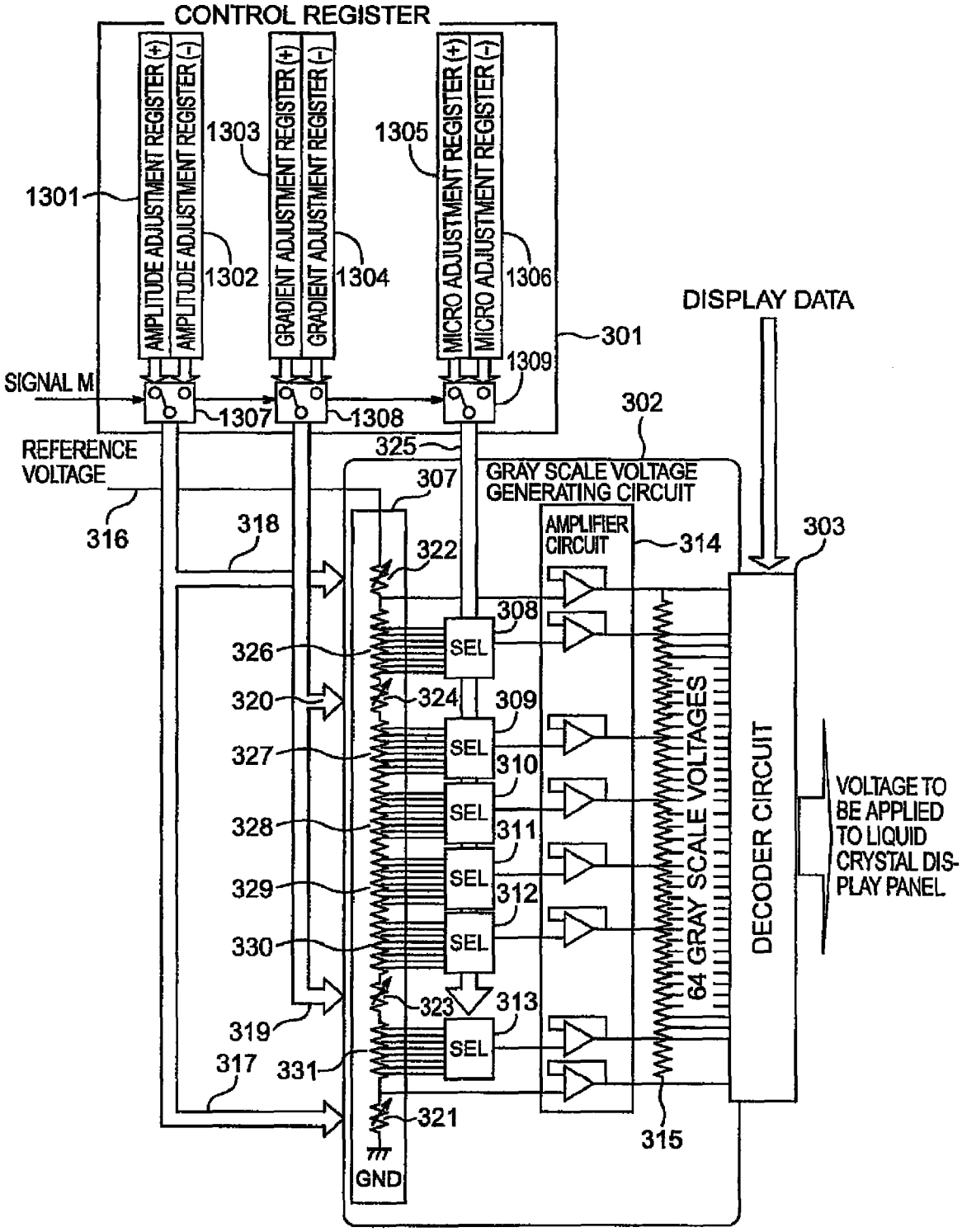
FIG. 13 is a block diagram showing a configuration of a gray scale voltage generating circuit according to a third embodiment of the present invention.

Next, a configuration of a gray scale voltage generating circuit according to a third embodiment will be shown in FIG. 13. In this embodiment, a single resistance ladder is provided in place of two resistance ladders according to the second embodiment. The adjustment registers according to the first embodiment such as the amplitude adjustment register, gradient adjustment register, and micro adjustment register are provided separately according to the polarities of gray scale voltage, thereby allowing separate adjustments to the gamma characteristics for both positive and negative gray scale voltages. FIG. 13 shows the gray scale voltage generating circuit in FIG. 3 according to the first embodiment, of which only the internal configuration of the control register 301 is modified. Thus, the configurations and the operations of the gray scale voltage generating circuit 302 and the decoder circuit 303 are the same as those in FIG. 1. Referring to the internal configuration of the control register 301 in FIG. 13, reference numeral 1301 denotes an amplitude adjustment register for positive gray scale voltages, reference numeral 1302 denotes an amplitude adjustment register for negative gray scale voltages, reference numeral 1303 denotes a gradient adjustment register for positive gray scale voltages, reference numeral 1304 denotes a gradient adjustment register for negative gray scale voltages, reference numeral 1305 denotes a micro adjustment register for positive gray scale voltages, and reference numeral 1306 denotes a micro adjustment register for negative gray scale voltages, in each of which setting can be performed separately according to the polarity of a gray scale voltage. The adjustment registers 1301 to 1306 select settings in the registers 1301 to 1306 according to the polarity of a gray scale voltage by using selector circuits 1307 to 1309 for performing selection in response to the M signal. When the polarity of the M signal is zero, the selector circuits 1307 to 1309 select settings in the registers 1301, 1303, and 1305 for positive gray scale voltages, respectively. When the polarity of the M signal is one, the selector circuits 1307 to 1309 select settings in the registers 1302, 1304, and 1306 for negative gray scale voltages, respectively. The amplitude adjustment registers 1301 and 1302 for positive and negative gray scale voltages achieve the same effects shown in FIGS. 5A, 5B, and 5C as the amplitude adjustment register according to the first embodiment. The gradient adjustment registers 1303 and 1304 for positive and negative gray scale voltages achieve the same effects shown in FIGS. 6A, 6B, and 6C as the gradient adjustment register according to the first embodiment. The micro adjustment registers 1305 and 1306 for positive and negative gray scale voltages achieve the same effects shown in FIG. 8 as the micro adjustment register according to the first embodiment.

Accordingly, the adjustment registers 1301 to 1306 for positive and negative gray scale voltages, described above can provide the same effect as the first embodiment. Adjustment to gray scale voltages and the gamma characteristics according to the characteristics of respective liquid crystal display panels can be thereby made separately for both of positive and negative gray scale voltages.

Figure 14:
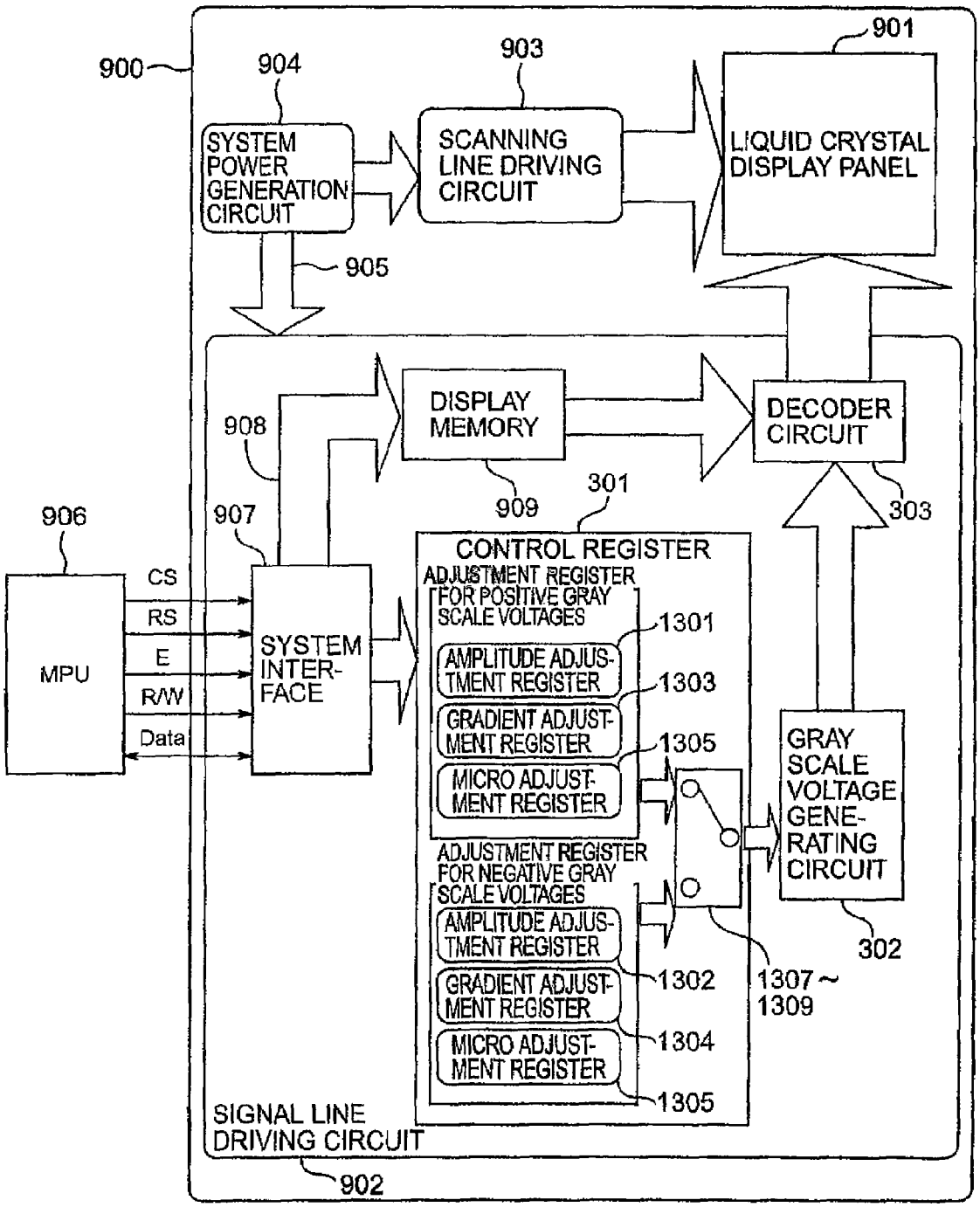
FIG. 14 is a block diagram showing a configuration of a liquid crystal display apparatus system according to a second embodiment of the present invention.

By including the control register 301 having the configuration as described above in a liquid crystal display apparatus system in FIG. 14, a liquid crystal display apparatus with a circuit size smaller than that according to the second embodiment is realized, which can adjust the gamma characteristics for both positive and negative gray scale voltages. Settings in the adjustment registers 1301 to 1306 for positive and negative gray scale voltages are written into the control register 301 at the respective addresses assigned to the positive and negative adjustment registers 1301 to 1306 in response to the control signals like those in FIG. 10.

Next, a configuration of a liquid crystal display apparatus according to a third embodiment of the present invention will be described.

In liquid crystal display panels, depending on an application, an image is sometimes displayed by backlighting. In this case, the gray scale number-gray scale voltage characteristic of a liquid crystal display panel sometimes changes according to turning ON or OFF of backlight, so that adjustment to the gamma characteristic should be made. In this embodiment, a method of adjusting the gamma characteristic during the period where the backlight is turned ON or OFF as described above will be described with reference to FIG. 15.

Figure 15:
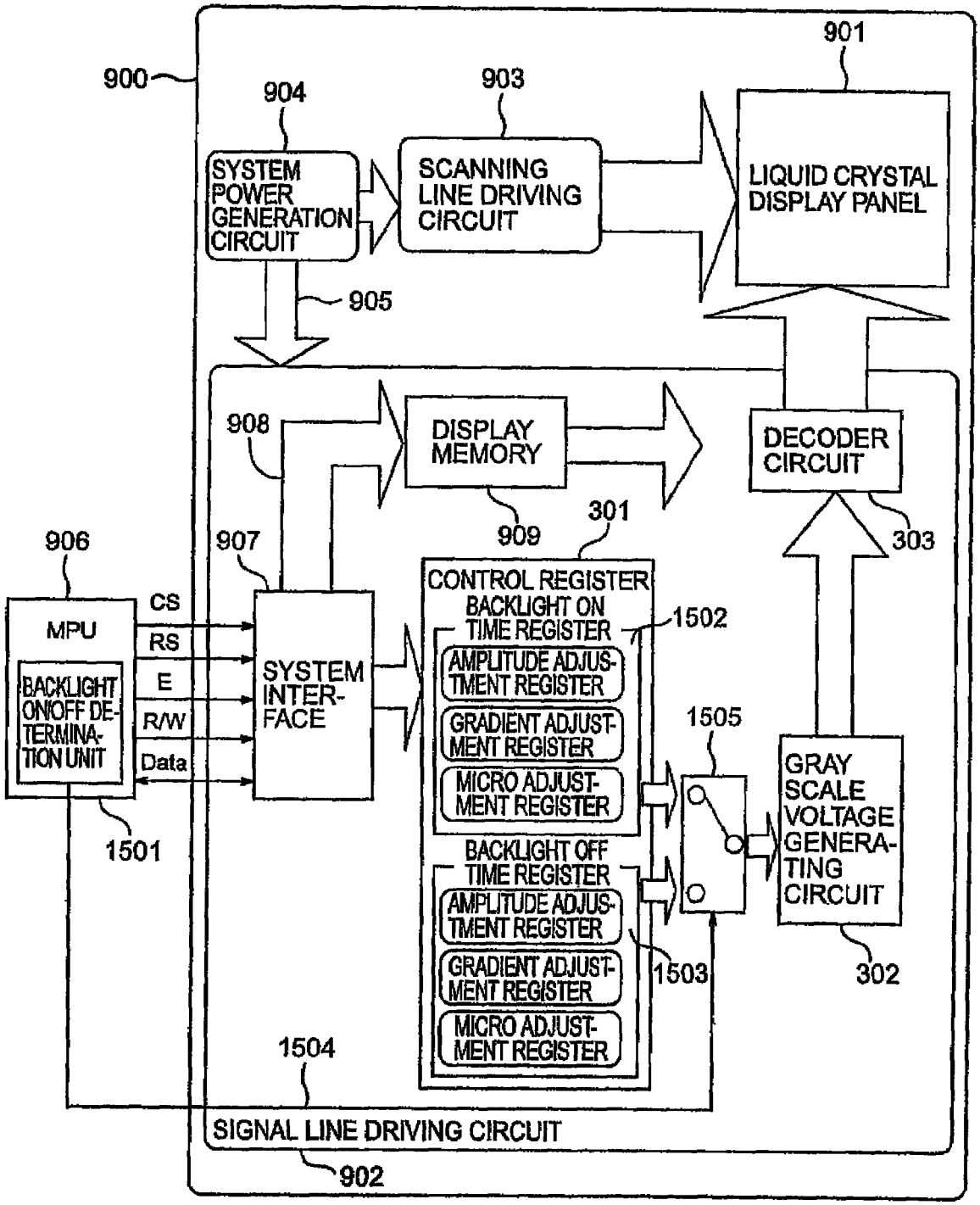
FIG. 15 is a block diagram showing a configuration of a liquid crystal display apparatus system according to a third embodiment of the present invention.

FIG. 15 is the liquid crystal display apparatus system in FIG. 9 according to the first embodiment, in which the internal configurations of the MPU 906 and the control register 301 in the signal line driving circuit 902 are modified. Although the configurations and the operations of other blocks are the same as those in the first embodiment, the liquid crystal display panel 901 includes a circuit for backlighting described above. Backlight ON/OFF determination unit 1501 for determining whether the backlight is turned ON or OFF is provided inside the MPU 906, and a backlight ON time register 1502 and a backlight OFF time register 1503 are provided separately inside the control register 301. The backlight ON time register 1502 includes the amplitude adjustment register 304, gradient adjustment register 305, and micro adjustment register 306 that achieve the same effects as those according to the first embodiment. The backlight OFF time register 1503 also includes the amplitude adjustment register 304, gradient adjustment register 305, and micro adjustment register 306 that achieve the same effects as those according to the first embodiment. In response to a determination signal 1504 indicating the state where the backlight is turned ON or OFF, supplied from the backlight ON/OFF determination unit 1501, the selector circuit 1505 makes selection between a setting in the backlight ON time register 1502 and a setting in the backlight OFF time register 1503 to use the register setting selected by the selector circuit 1505 in the gray scale voltage generating circuit 302 which has the same configuration as that according to the first embodiment.

As described above, by providing for the control register 301 two types of amplitude adjustment registers, gradient adjustment registers, and micro adjustment registers all of which achieve the same effects as those according to the first embodiment during the periods where the backlight is turned ON and OFF, separate adjustments to the gamma characteristic of the respective liquid crystal display panels can be made, depending on whether the backlight is turned ON or OFF. A liquid crystal display apparatus where high image quality can be effected is thereby realized. Settings in the backlight ON time register 1402 and the backlight OFF time register 1403 are assigned to respective addresses in the control register 301 and written into the control register 301 at the respective addresses in response to control signals in FIG. 10, as in the first embodiment.

Next, a configuration of a liquid crystal display apparatus according to a fifth embodiment of the present invention will be described.

This embodiment allows separate gamma characteristic adjustments for respective liquid crystal display panel colors of red, green, and blue (to be referred to as R, G, and B, respectively). The configuration of the apparatus will be described with reference to FIG. 16.

Figure 16:
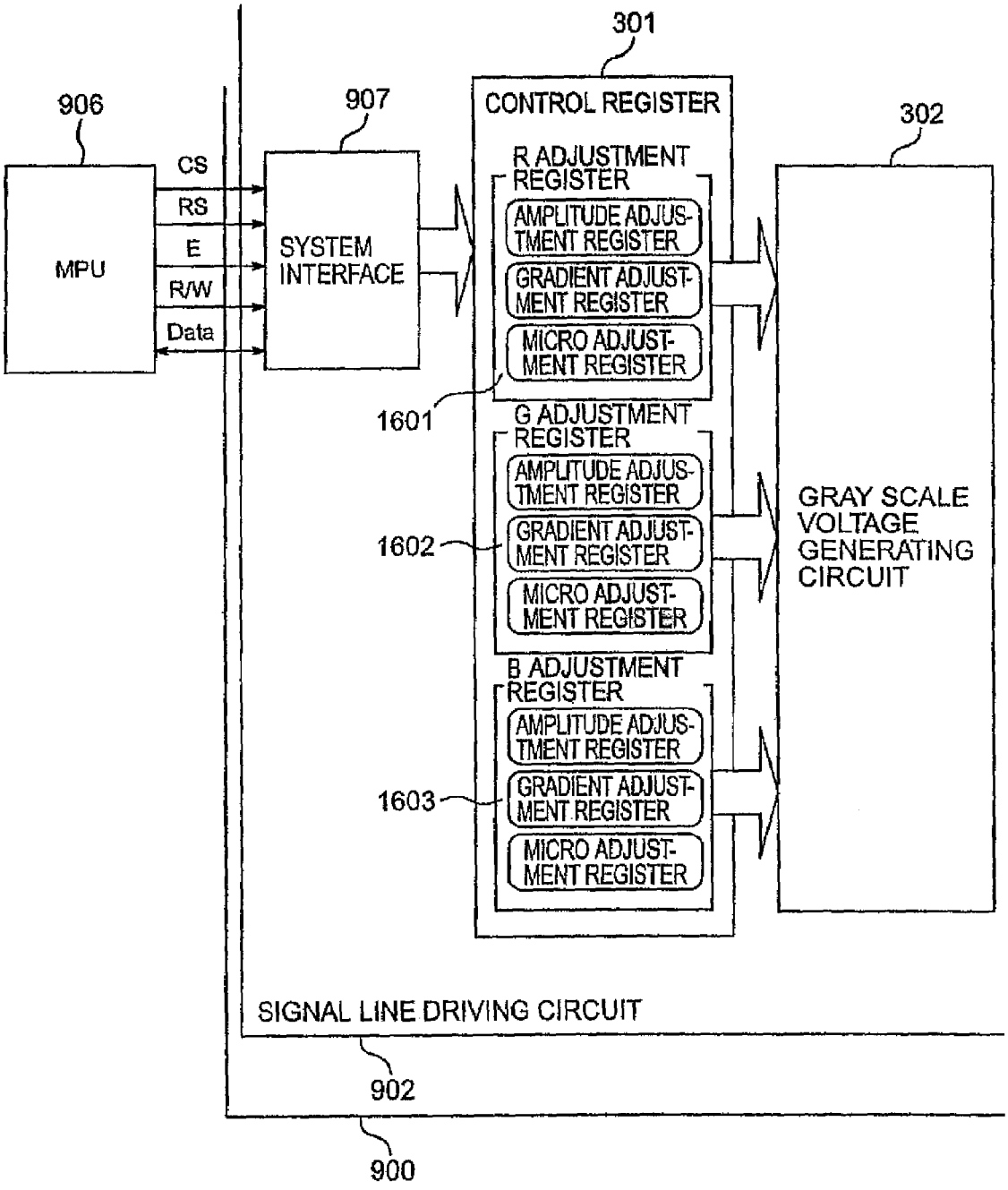
FIG. 16 is a block diagram showing a configuration of a liquid crystal display apparatus system according to a fourth embodiment of the present invention.

FIG. 16 is the liquid crystal display apparatus system in FIG. 9 according to the first embodiment, in which only the internal configuration of the control register 301 is modified, as in FIG. 15 according to the fourth embodiment. The configurations and the operations of other blocks are the same as those in the first embodiment. In order to make separate gamma characteristic adjustments for respective R, G, and B, an R adjustment register 1601, a G adjustment register 1602, and a B adjustment register 1603 are provided separately in the control register 1603. All of the adjustment registers 1601 to 1603 include the amplitude adjustment register 304, gradient adjustment register 305, and micro adjustment register 306, respectively, which achieve the same effects as those according to the first embodiment.

As described above, registers for respective display colors are separately provided in the control register 301 in the liquid crystal display. These registers include the R adjustment register 1601, G adjustment register 1602, and B adjustment register 1603 each of which comprise the amplitude adjustment register, gradient adjustment register, and micro adjustment register that achieve the same effects as those according to the first embodiment. With this arrangement, separate gamma characteristic adjustments for the respective display colors of R, G, and B in the liquid crystal display panel become possible, so that the liquid crystal display apparatus is realized in which high image quality can be effected. Settings in the R adjustment register 1601, G adjustment register 1602, and B adjustment register 1603 are assigned to respective addresses in the control register 301 and written into the control register 301 at the respective addresses in response to the control signals in FIG. 10, as in the first embodiment.

The present invention is not limited to the embodiments described above, and various modifications are possible. To take an example, the above description was given, assuming that the liquid crystal display panel is in the normally black mode. The present invention, however, can be practiced irrespective of the modes of the liquid crystal display panel. Further, a description was given, assuming that the number of gray scale levels is 64. The present invention, however, can be practiced irrespective of the number of gray scale levels.

According to the first to fourth embodiments, in order to make adjustment to the gamma characteristic, the amplitude adjustment register and the gradient adjustment register are provided. Then, a resistance ladder is provided which can make rough adjustments to gray scale voltages such as amplitude voltage adjustments to the gray scale voltages and the gradient characteristic of the gray scale voltages of intermediate gray scale levels. These adjustments are made according to the characteristics of the respective liquid crystal display panels, by using settings in the registers. With this arrangement, adjustment to the gamma characteristic can be facilitated, so that an adjustment time can be shortened. Further, by using the resistance ladder to allow the adjustments to be made, the size of the gray scale voltage generating circuit can be reduced at a low cost.

Further, in addition to the amplitude adjustment register and the gradient adjustment register, the micro adjustment register is provided. With this arrangement, micro adjustment to the gray scale voltages which have been adjusted by the amplitude and gradient adjustment registers becomes possible. Adjusting accuracy can be thereby increased, and high image quality can be effected.

Still further, according to the first to fourth embodiments, gamma characteristic adjustments according to the characteristics of respective liquid crystal display panels become possible. Thus, a versatile circuit configuration can be constructed.

According to the present invention, the accuracy of gamma characteristic adjustment is improved in a liquid crystal display apparatus. Image quality is thereby improved.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A display driving circuit to supply a gray scale voltage corresponding to display data to a display panel, the display driving circuit comprising:

a generation circuit to divide a reference voltage to generate a plurality of levels of the gray scale voltages;

an interface circuit;

a selection circuit to select the gray scale voltage corresponding to the display data from the plurality of levels of voltages;

a first register to store a setting value that adjusts the amplitude of a gamma characteristic curve from outside via the interface circuit; and a second register to store a setting value that adjusts the gradient of the gamma characteristic curve from outside via the interface circuit; and a third register to store a setting value for micro adjusting the gamma characteristic curve from outside via the interface circuit;

wherein the first, second and third registers are assigned different addresses.

2. A display driving circuit according to claim 1, wherein the respective setting values of the first, second and third registers can be set separately in accordance with a polarity of the gray scale voltage.

3. A display driving circuit according to claim 1, wherein the respective setting values of the first, second and third registers can be set separately in accordance with colors of red, green and blue respectively.

4. A display driving circuit according to claim 1, wherein the display panel contains a backlight illuminating display pixels, the respective setting values of the first, second and third registers can be set separately in accordance with a state of the backlight.

5. A display device, comprising:

the driving circuit according to claim 1;

a processing unit, connected with the interface circuit of the display driving circuit, and supplying the display data, the respective addresses and setting values of the first to third registers to the display driving circuit; and the display panel connected with the display driving circuit.

6. A display driving circuit to supply a gray scale voltage corresponding to display data to a display panel, the display driving circuit comprising:

a generation circuit to divide between a first level voltage and a second level voltage by a group of resistive circuits, a variable resistor and a selector circuit to generate a plurality of levels of voltages;

a decoder circuit to decode the gray scale voltage corresponding to the display data among the plurality of levels of voltages; and registers which is capable of setting the resistance values of the variable resisters and based on a selected position of the selector circuit to adjust the amplitude and gradient of a characteristic curve of the gray scale voltages and micro adjust the gradient of the characteristic curve of the gray scale voltages with respect to the gray scale number, and an interface circuit;

where the registers include:

a first register which is capable of setting a resistive value of the variable resister for setting the amplitude of the characteristic curve from outside via the interface circuit;

a second register which is capable of setting a resistive value of the variable resistor for setting the gradient of the characteristic curve from outside via the interface circuit; and a third register which is capable of setting a value for setting a selected position of the selector circuit to micro-adjust the gradient of the characteristic curve from outside via the interface circuit, wherein the first, second and third registers are assigned different addresses.

7. A display driving circuit according to claim 6, wherein the respective setting values of the first, second and third registers can be set separately in accordance with a polarity of the gray scale voltage.

8. A display driving circuit according to claim 6, wherein the respective setting values of the first, second and third registers can be set separately in accordance with colors of red, green and blue respectively.

9. A display driving circuit according to claim 6, wherein the display panel contains a backlight illuminating display pixels, where the respective setting values of the first, second and third registers can be set separately in accordance with a state of the backlight.

10. A display device, comprising:

the driving circuit according to claim 6;

a processing unit, connected with the interface circuit of the display driving circuit, and supplying the display data, the respective addresses and setting values of the first to third registers to the display driving circuit; and the display panel connected with the display driving circuit.

11. A display driving circuit to supply a gray scale voltage corresponding to display data to a display panel in which a plurality of pixels are arranged, the display driving circuit comprising:

a generation circuit to divide a reference voltage to generate a plurality of levels of voltages corresponding to a plurality of gray scales;

a decoder circuit to select the gray scale voltage corresponding to the display data among the plurality of levels of voltages;

a first register which is set with a first value for the reference voltage dividing ratio to adjust the amplitude of a gamma characteristics determining the relationship between the gray scales and the gray scale voltages or the brightness in the display panel;

a second register which is set with a second value for the reference voltage dividing ratio to adjust the gradient of the middle part of the hi characteristics;

a third register which is set with a third value for the reference voltage dividing ratio to micro adjust the middle part of the gamma characteristics respect to each gray scale.

12. A display driving circuit according to claim 11, wherein the values of the first to third registers can be set separately from outside.

13. A display driving circuit according to claim 12, wherein the generation circuit comprise:

a first resistance ladder which is connected between a terminal of a first reference voltage and a terminal of a second reference voltage;

a first variable resistor which is connected with the first resistance ladder in series, being closer to the side of the terminal of first reference voltage or the terminal of second reference voltage;

a second variable resistor which is connected with the first resistance ladder in series, being in the middle of the first resistance ladder;

a selector to select the output of the first resistance ladder;

an amplifier which is connected with the output side of the selector; and a second resistance ladder connected among the plurality of output of the amplifier, wherein the resistive value of the first variable resistor can vary in accordance with the first value in the first register, wherein the resistive value of the second variable resistor can vary in accordance with the second value in the second register, and wherein the selector can select the output of the first resistance ladder in accordance with the third value in the third register.

14. A display driving circuit according to claim 11, wherein the respective setting values of the first, second and third registers can be set separately in accordance with a polarity of the gray scale voltage.

15. A display driving circuit according to claim 11, wherein the respective setting values of the first, second and third registers can be set separately in accordance with colors of red, green and blue respectively.

16. A display driving circuit according to claim 11, wherein the display panel contains a backlight illuminating display pixels, and wherein the respective setting values of the first, second and third registers can be set separately in accordance with a state of the backlight.

17. A display device, comprising:

the driving circuit according to claim 11;

a processing unit, connected with the display driving circuit, and supplying the display data, the first value to be set to the first register, the second value to be set to the second register and the third value to be set to the third register, to the display driving circuit; and the display panel connected with the display driving circuit.

* * * * *